US009884369B2

(12) United States Patent
Lancaster-Larocque et al.

(10) Patent No.: US 9,884,369 B2
(45) Date of Patent: Feb. 6, 2018

(54) SOLID STATE DEPOSITION METHODS, APPARATUSES, AND PRODUCTS

(71) Applicant: Apple Inc., Cupertino, CA (US)

(72) Inventors: Simon Regis Louis Lancaster-Larocque, Gloucester (CA); Ari P. Miller, San Francisco, CA (US); Laura M. DeForest, San Mateo, CA (US); Michelle R. Goldberg, Sunnyvale, CA (US); William F. Leggett, San Francisco, CA (US); Adam T. Garelli, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 51 days.

(21) Appl. No.: 14/577,723

(22) Filed: Dec. 19, 2014

(65) Prior Publication Data

US 2015/0246394 A1 Sep. 3, 2015

Related U.S. Application Data

(60) Provisional application No. 61/947,284, filed on Mar. 3, 2014.

(51) Int. Cl.

| | |
|---|---|
| ***B05D 1/10*** | (2006.01) |
| ***B22F 3/24*** | (2006.01) |
| ***B05D 1/12*** | (2006.01) |
| ***H04R 1/28*** | (2006.01) |
| ***C23C 24/04*** | (2006.01) |
| ***C23C 28/02*** | (2006.01) |

(52) U.S. Cl.
CPC ..... *B22F 3/24* (2013.01); *B05D 1/10* (2013.01); *B05D 1/12* (2013.01); *C23C 24/04* (2013.01); *C23C 28/02* (2013.01); *H04R 1/2811* (2013.01)

(58) Field of Classification Search
USPC ..... 427/98.4, 99.2, 421.1
See application file for complete search history.

(56) References Cited

U.S. PATENT DOCUMENTS

| | | | | |
|---|---|---|---|---|
| 7,176,048 | B1 * | 2/2007 | Burns | G01L 1/103 257/E31.001 |
| 2002/0012825 | A1 * | 1/2002 | Sasahara | H01M 4/86 429/482 |
| 2004/0146650 | A1 * | 7/2004 | Lockard | C23C 4/02 427/307 |
| 2007/0298238 | A1 * | 12/2007 | Witvrouw | B81C 1/00293 428/304.4 |
| 2012/0114861 | A1 * | 5/2012 | Cohen | B81C 1/00492 427/355 |

(Continued)

OTHER PUBLICATIONS

Victor Champagne, Technical Team Leader; "Cold Spray Technology for DOD Applications", Innovative Materials & Processing Team, US Army Research Laboratory, 46 pages.

(Continued)

*Primary Examiner* — Brian K Talbot
(74) *Attorney, Agent, or Firm* — Downey Brand LLP

(57) ABSTRACT

The described embodiments relate generally to methods for forming structures by solid state deposition processes. More specifically a method for depositing cold spray over a removable body is disclosed. Methods are also disclosed for affixing operational and structural components to a surface of a device housing with cold spray.

14 Claims, 27 Drawing Sheets

(56) References Cited

U.S. PATENT DOCUMENTS

2012/0161257 A1* 6/2012 Friza ..... B81C 1/00047 257/416
2015/0056407 A1* 2/2015 Astier ..... G01N 27/4145 428/137

OTHER PUBLICATIONS

Tanvir Hussain, MSc, "A study of bonding mechanisms and corrosion behavior of cold sprayed coatings", University of Nottingham, Jan. 2011, 320 pages.

* cited by examiner

SOLID STATE DEPOSITION METHODS, APPARATUSES, AND PRODUCTS

CROSS-REFERENCE TO RELATED APPLICATION

This application claims priority to U.S. Provisional Application Ser. No. 61/947,284 filed Mar. 3, 2014 entitled "Solid-State Deposition Methods, Apparatuses, And Products", which is incorporated herein by reference in its entirety.

FIELD

This paper describes various embodiments that relate to using solid state deposition (also referred to as cold spray) in manufacturing. Solid state deposition methods, apparatuses, and systems can also be used to provide structures not easily provided using conventional techniques. In particular, solid state deposition processes can be used to accomplish any of the following: create layered structures within which operational components can be disposed; join two components formed of differing materials; form a part completely from cold spray materials; form a light weight structural rib; couple components to a housing without adhesive; and form a substantially sealed cavity operable as an EMI shield or audio volume.

BACKGROUND

Electronic devices may include several aesthetic features, particularly on exterior surfaces. These features may be formed by various methods. However, during a manufacturing process the exterior surfaces may be damaged during the formation of other parts or features. Also, electronic devices may include various internal features that may become decoupled, even when an adhesive is used.

SUMMARY

In one aspect, a method for forming a void having a defined size and shape within a metallic structure is described. The method may include spraying several discrete metallic particles on at least a portion of a sacrificial body having the defined size and shape. In some embodiments, at least some of the several discrete metallic particles join together subsequent to the spraying to form a metallic layer that includes the joined metallic particles. The method may further include forming the void having the defined size and shape within the metallic layer by removing the sacrificial body in a manner that an external surface of the metallic layer remains essentially undisturbed. The method may further include altering a portion of an external surface of the metallic layer to form the metallic structure.

In another aspect, a method of electrically isolating an electrical component is described. The method may include forming a layer of metal comprising a plurality of discrete metallic particles joined together covering at least a portion of a sacrificial body that carries the electrical component. In some embodiments, at least a portion of the layer of metal acts as a conductive shield that inhibits passage of electromagnetic energy. The method may further include removing the sacrificial body in a manner that leaves the electrical component substantially unaffected and the conductive shield undisturbed.

In another aspect, an electronic device is described. The electronic device may include a housing. The electronic device may further include a component assembly carried by the housing. The component assembly may include an enclosure formed of a solid state deposition layer including several discrete metallic particles joined together that form a corresponding metallic layer having identifiable joined regions that encloses and defines an internal volume. The component assembly may further include a component at least partially disposed within the internal volume.

In some cases, a removable body can be formed into complex shapes using low melt material such as plastic that can then be embedded within an enclosure using a solid state deposition process. In this way, complex internal shapes having features (such as undercuts) that can be difficult to create can nonetheless be formed within an enclosure without resorting to complex machining operations.

In some cases, thermal paths within the walls on an enclosure can be formed. The thermal paths can be formed of thermally conductive material (that may or may not also be electrically conductive). The thermally conductive paths can be used to transport heat from a heat source (such as an operational component) and a heat sink (such as a fin stack).

In some cases, cavities can be formed within the walls of an enclosure. The cavities can be formed using a removable body approach. The cavities can be used in many ways. For example, the cavities can be used to reduce an overall weight of the enclosure without seriously affecting the overall strength. Further, the cavities can take on stress-distributing shapes (such as a honeycomb or ribs) that can be used to evenly distribute loads applied to the housing. In some cases, the cavities can be used as acoustic volumes for enhancing audio performance of a speaker or other type audio transducer.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The described embodiments may be better understood by reference to the following description and the accompanying drawings. Additionally, advantages of the described embodiments may be better understood by reference to the following description and accompanying drawings in which.

Figure 1:
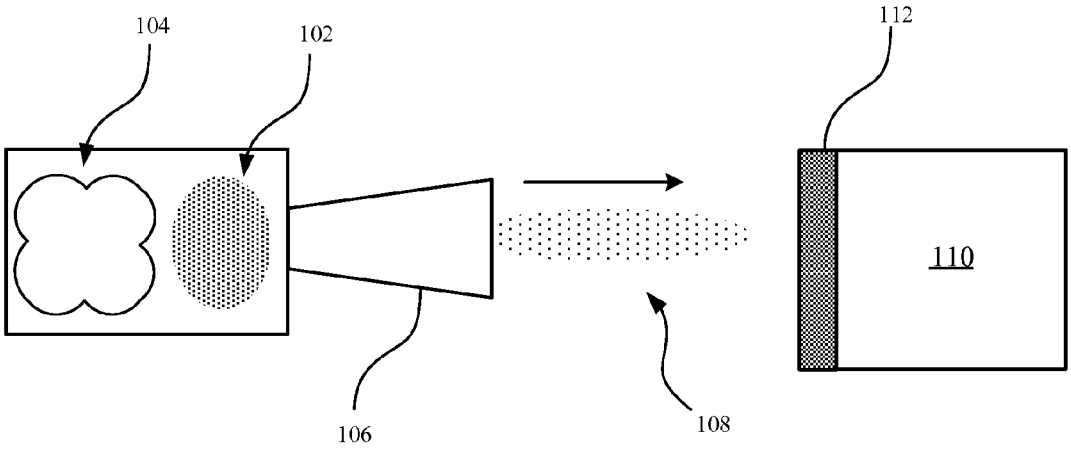
FIG. 1 illustrates a simplified representation of a cold spray process, in accordance with the described embodiments of the present disclosure.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION OF SELECTED EMBODIMENTS

Representative applications of methods and apparatuses according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments. These and other embodiments are discussed below. However, those skilled in the art will readily appreciate that the detailed description given herein with respect to these figures is for explanatory purposes only and should not be construed as limiting.

Solid state deposition methods, apparatus, and systems can be also used to provide structures not easily provided using conventional techniques. For example, solid state deposition techniques can be used to provide a multi-layered housing. The multi-layered housing can be formed using any number of processes that utilize solid state deposition of materials having desired properties. Solid state deposition formed from thermally conductive materials can be used to form a thermal path in the form of a conduit, such as a heat pipe, within an enclosure. Once the conduit is formed the heat pipe can be rendered functional by adding a cooling medium, such as water, that undergoes a suitable phase change within the conduit. Electrically conductive material can be used to form electrically conductive traces on electrically insulating material. For example, copper can be deposited using a suitable solid state deposition process on an electrically insulating layer, such as aluminum oxide. In some cases, metals such as titanium can also be used. In some cases, metals such as titanium can undergo a more rigorous deposition process in that the titanium metal can be embedded within the aluminum oxide and not just as a layered deposition on the surface of the aluminum oxide. In this way, solid state deposition of materials formed on an electrically insulating layer (such as aluminum oxide) can be used to form electrical traces or conductive paths. Such electrical traces or conductive paths can be used as antenna or be used as grounding paths. Also, in some cases, electrically conductive layers can be embedded within a housing.

In some cases, a removable body can be embedded within a housing by overlaying material using a suitable solid state deposition process. For example, the removable body can be formed into complex shapes using low melt material such as plastic that can then be embedded within an enclosure using a solid state deposition process. In this way, complex internal shapes having features (such as undercuts) that can be difficult to create can nonetheless be formed within an enclosure without resorting to complex machining operations. It should be noted that once the complex-shaped body is in place, a solid state deposition process can then be used to overlay the complex-shaped body with a suitable material having a melting point higher than that of the complex-shaped body. In some cases, the solid state overlay can be machined to a desired external shape and heated to a temperature greater than the melting point of the complex-shaped body embedded therein. In this way, the body can be removed by melting or undergoing some other change of state or phase. In some cases, the complex-shaped body can include portions that can be used to form reinforcing structures such as ribs, trusses, and so on.

In some cases, cavities can be formed within the walls of an enclosure. The cavities can be formed using the removable body approach discussed above. The cavities can be used in many ways. For example, the cavities can be used to reduce an overall weight of the enclosure without seriously affecting the overall strength. For example, the cavities can take on stress distributing shapes (such as a honeycomb or ribs) that can be used to evenly distribute loads applied to the housing. In some cases, the cavities can be used as acoustic volumes for enhancing audio performance of a speaker or other type audio transducer.

The removable body can also include components embedded within that can remain behind after the material that forms the body has been removed. The components can be passive or active electrical components (for example, speaker boxes or transducers) that can withstand the effects of the solid state deposition process and any subsequent removal process requiring elevated temperatures. In this way, components can be embedded within walls of an enclosure without resorting to complex and difficult-to-perform machining operations. The components can also include structural elements.

A multi-layer housing formed of materials layered according to a desired property or properties can be provided. The layers can be formed of material that is either or both electrically and thermally conductive, and in addition provide reinforcement structures. For example, electrically conductive layers formed of suitable conductive material (such as copper) can be used to form an electrically conductive layer within the walls of an enclosure. The conductive layers can be electrically isolated from surrounding enclosure material (such as aluminum or steel) that would cause electric charge leakage. Accordingly, layered structures within the walls of the enclosure can include electrically conductive layers separated by non-conductive layers that isolate the electrically conductive layers from each other.

In some cases, thermal paths within the walls on an enclosure can be formed. The thermal paths can be formed of thermally conductive material (that may or may not also be electrically conductive). The thermally conductive paths can be used to transport heat from a heat source (such as an operational component) and a heat sink (such as a fin stack).

In some embodiments, cavities can be formed within the wall of an enclosure and replaced with material having a lesser density than that of the material that forms the enclosure. In this way, the overall weight of the enclosure can be reduced. In some cases, the material can also provide improved strength and resistance to impact. Such materials can include, for example, carbon fibers, and so forth. As noted above, the lighter weight materials can be incorporated into a sacrificial body (discussed above) that can be embedded within the walls of the enclosure and then removed by any suitable mechanism (such as melting a low melt temperature material). In this way, the thermally conductive paths act as a heat pipe or other heat transport mechanism.

In some embodiments, local features formed of material that is dissimilar to that of the base substrate of the enclosure can be attached in accordance with a solid state deposition process. For example, a nut or (threaded) boss can be attached to an enclosure. In this way, the nut or boss can be used to support a fastener in tension that is nonetheless well adapted to resist compressive forces due to the solid state deposition used to attach the nut or boss. In one situation, a local feature can be formed on an extruded substrate without resorting to machining operations that can be costly in time, material, and expense. For example, a local feature such as a nut or boss (formed of stainless steel, as an example) can be attached to a substrate formed of a dissimilar material (such as aluminum) that would not otherwise be suitable for conventional securing operations such as welding (laser welding, as an example).

Solid state deposition processes to cosmetically enhance the appearance of a joint, to form structural elements within and on substrates, and other applications of solid state deposition processes are also discussed hereinafter. Solid state deposition processes function by propelling particles at high velocity to impact a substrate. When the particles impact the substrate, the particles undergo plastic deformation, forming a metallurgical bond to the surface. The most common method of solid state deposition is known as "cold spray." Cold spray is used traditionally in repair processes, such as in repair of military equipment. Various other embodiments of solid state deposition, which may also be referred to as thermal spraying include, for example, plasma spraying, detonation spraying, wire arc spraying, flame spraying, high velocity oxy-fuel (HVOF) coating spraying, and warm spraying.

Because solid state deposition is a solid state process, it has many advantages as such as reduced heat input, oxidation, and grain growth. Further advantages of solid state deposition, and in particular cold spray are as follows: high deposition rate, no or little masking required, no grit blast required, high density, flexibility in substrate coating, minimum thermal input to substrate, high bond strength, compressive residual stresses, ultra-thick coatings (optional), no oxidation, no grain growth, high conductivity, high corrosion resistance, and high strength and hardness.

A simplified diagram of the cold spray process is shown in FIG. 1. As illustrated, the cold spray process may include directing powder particles 102 and a carrier gas 104, which may be heated, through a nozzle 106. The resulting high-velocity particle-gas mixture 108 may thus be directed at a substrate 110. As the high-velocity particle-gas mixture 108 impacts the substrate 110, a layer of deposited material 112 may form thereon as the particles plastically deform and bond to substrate 110. The thickness of the resulting layer of deposited material 112 continues to build to the extent desired as additional particles are directed thereto. Due to the high velocity emission (and resultant high kinetic energy) of the particles form the nozzle 106, the particles may join together with other particles upon impact. However, unlike other liquid-based depositions, the solid state deposition process defined by a cold spray still allows for the particles to be identifiable. That is, discrete, non-continuous particles joined together may still be individually identified.

One advantage of solid state deposition processes such as cold spray is that the material from which the powder particles are formed may be selected to define a desirable characteristic. Accordingly, for example, the material defining the powder particles may be selected to match the material defining the substrate. In some embodiments, the substrate defines a computer housing formed from aluminum (e.g., A1-6063-T6), and the powdered particles are formed from the same aluminum (e.g., AA6063-325 mesh/+10 microns or AA6063-325 mesh/+5 microns). However, as discussed below, differing materials may be selected in other embodiments.

The basic requirement for powder particles 102 is that they must be able to flow through the nozzle. Cold spray is done almost exclusively with atomized powder. The atomization process generates spherical particulates which flow well through the nozzle. For cold spray, the powder particles need to be approximately in the range of 5-50 μm diameter to be effective. Uniformity of the size of the powder particles is advantageous in that deposition rates increase with less variation in size.

With respect to carrier gas 104, typically helium and nitrogen are employed for cold spraying. Both gases are considered inert during cold spray. Helium is required to cold spray some high melting temperature alloys. This is because velocities achieved with nitrogen are insufficient to provide the kinetic energy required for the particle to bond with the substrate on impact. In this regard, the sonic velocity of helium is three times that of nitrogen. Further, attempting to soften some high melting temperature alloy powders to enable cold spray using nitrogen may not be feasible because it would require the nitrogen to be heated to a temperature at which the gas is no longer inert. However, helium gas may be considerably more expensive than nitrogen unless helium recycling systems are used. Accordingly, helium gas may be used only when high sonic velocities or pre-heat temperatures are required for the particular cold spray application. The solid state deposition (e.g., cold spray) process may be used in any of the embodiments below to form structures having various desired properties.

Figure 2A:
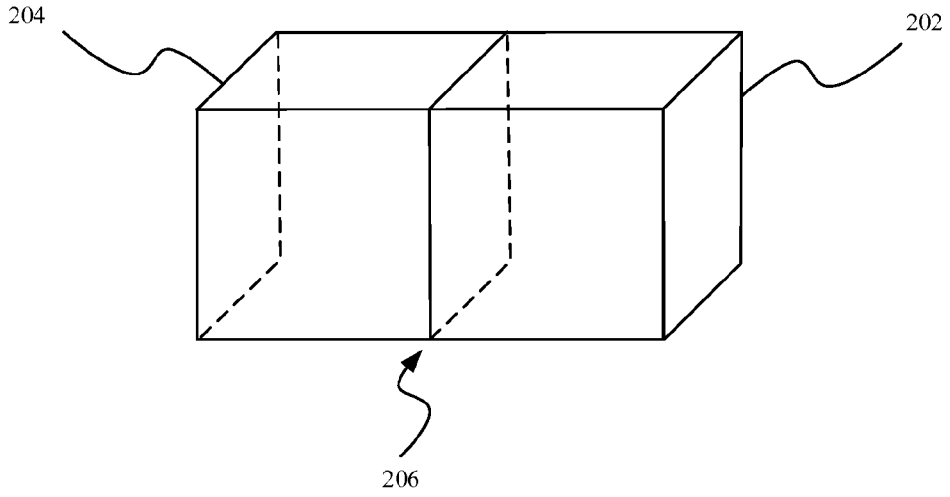
FIG. 2A illustrates an embodiment of a first part and a second part in contact at a planar interface.
Figure 2B:
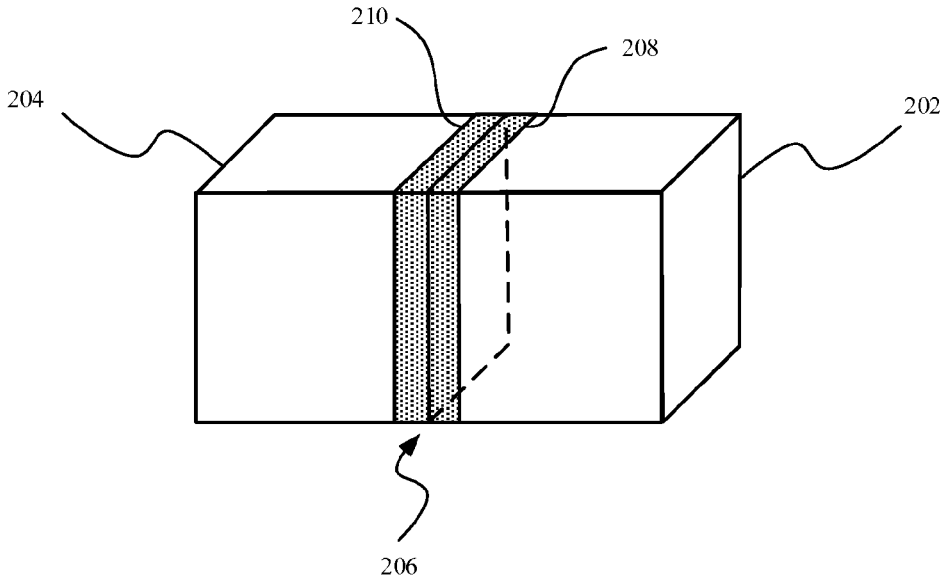
FIG. 2B illustrates the embodiment of the part of FIG. 2A joined at the planar interface by a solid state deposition operation.

Solid state deposition may also be employed for other purposes. In this regard, solid state deposition may be employed in joining two or more parts, as illustrated in FIGS. 2A and 2B. FIG. 2A shows first part 202 and second part 204 in contact at a planar interface 206. In some embodiments, the solid state deposition can itself be operable to join the parts 202, 204 together. More particularly, the parts 202, 204 can be joined together at the planar interface 206 by applying solid state deposition to respective outer surfaces 208, 210 of the parts 202, 204 proximate the interface, as depicted in FIG. 2B. Accordingly, the solid state deposition can extend across both sides of the planar interface 206 to join the parts 202, 204 together.

Figure 3:
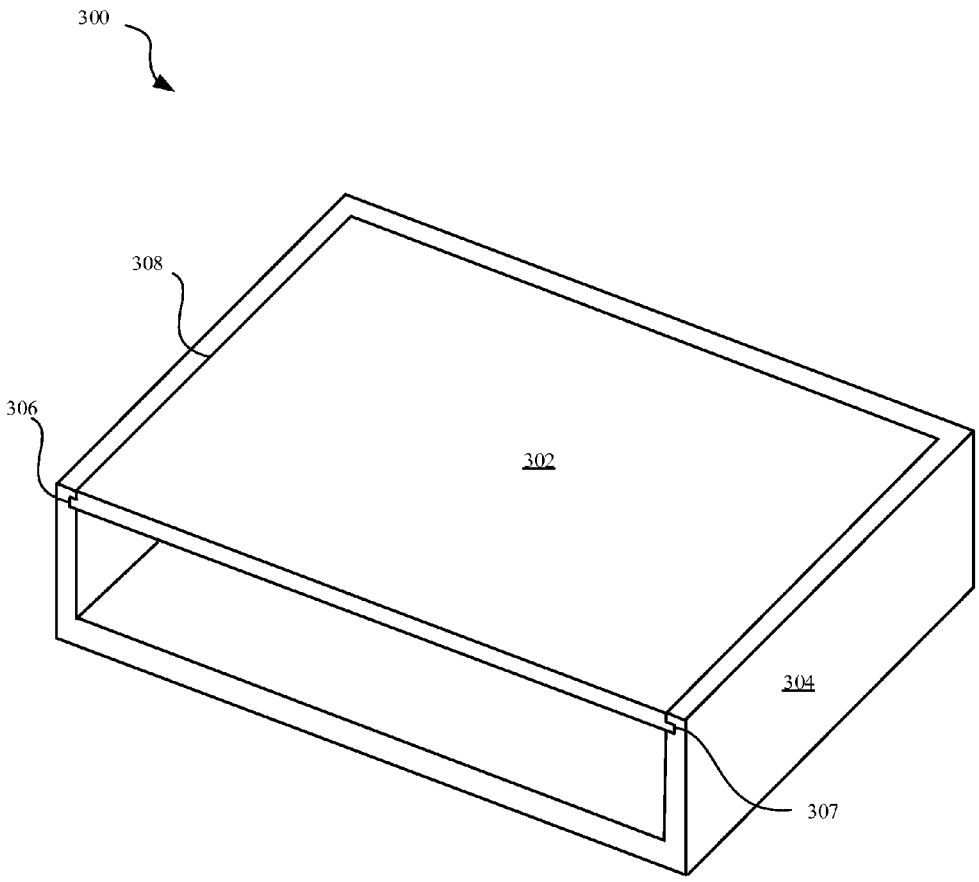
FIG. 3 illustrates a perspective view of an embodiment of a five-sided box reinforced by a cold spray operation.

FIG. 3 shows an embodiment in which cold spray is used to secure one side of housing 300. Plate 302 can slide within first groove 306 and second groove 307 of housing component 304. First groove 306 and second groove 307 can position plate 302 within housing component 304 so that plate 302 is disposed along a top surface of housing component 304. An interface 308 between plate 302 and housing component 304 can define a small gap that can be configured to receive cold spray material. By applying cold spray material within the gap defined by interface 308, plate 302 can be permanently affixed to housing component 304.

Figure 4A:
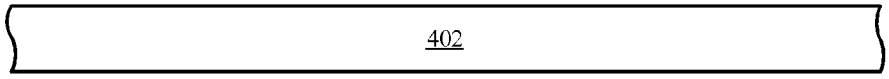
FIGS. 4A-4E illustrate a series of steps for securing a boss to a housing with a cold spray operation, in accordance with the described embodiments.
Figure 4B:
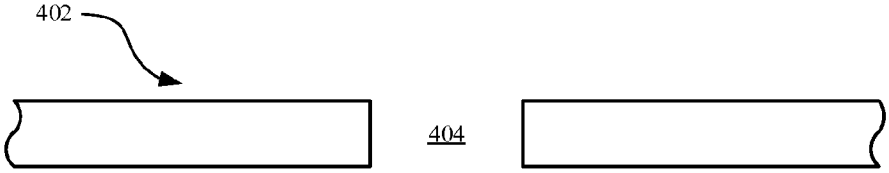
Figure 4C:
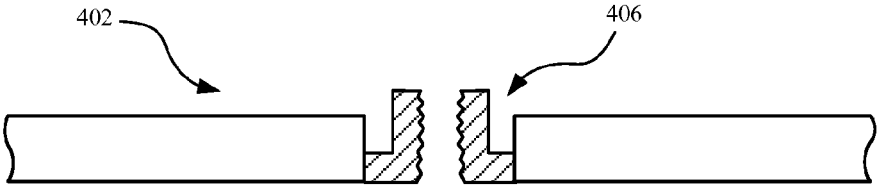
Figure 4D:
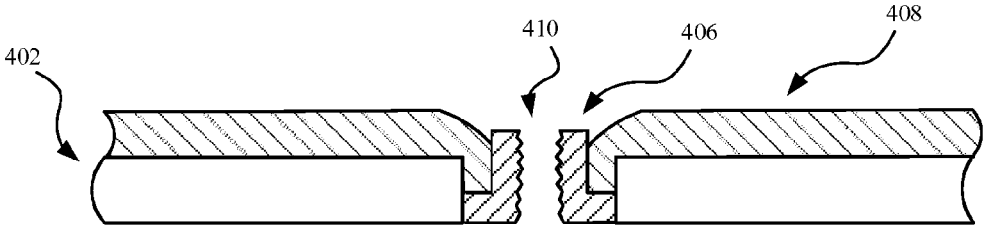
Figure 4E:
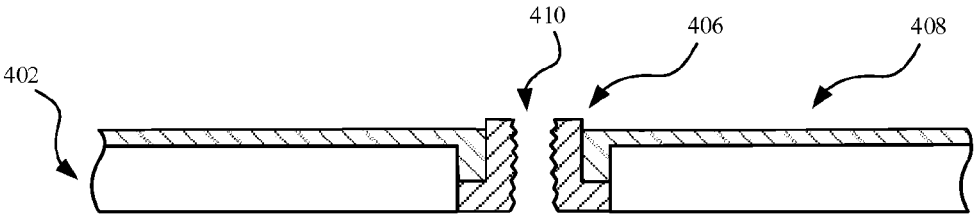

The particular parts joined by solid state deposition may vary. However, by way of example, FIGS. 4A-4E illustrate steps that can be taken to join a boss to a substrate via solid state deposition. FIG. 4A shows an exemplary substrate 402. In one particular embodiment, substrate 402 can be a relatively soft metal such as aluminum forming a portion of a device housing. FIG. 4B shows opening 404 machined through substrate 402. Opening 404 can have any of a number of geometries. For example, opening 404 can be circular or rectangular. FIG. 4C shows how subsequent to formation of opening 404, an insert can be placed within opening 404. In some embodiments, insert 406 can be a boss configured to receive a fastener. Regardless, at least a base portion of insert 406 has a size and shape such that it fits within opening 404. In some embodiments, a geometry of insert 406 that interacts with walls defining opening 404 can prevent insert 406 from rotating when disposed within opening 404. In FIG. 4D solid state deposition layer 408 is added along a top surface of substrate 402. In this way, insert 406 becomes secured within opening 404. An opening in insert 406 can be covered up by, for example a plug, to prevent entry of solid state deposition within opening 410 of insert 406. In a final step, FIG. 4E shows how a portion of solid state deposition layer 408 can be machined away to create a cosmetic surface proximate insert 406. Such an arrangement allows addition of a boss or attachment feature anywhere along a surface of a metal substrate. Solid-state deposition layer 408 can be configured to match substrate 402, allowing a cosmetic surface of substrate 402 to be maintained when desired. Another advantage of this configuration is that a robust coupling can be formed between substrate 402 and boss 406 even when the materials of the two components are highly dissimilar. For example, a boss 406 made from steel would not laser weld to substrate 402 when substrate 402 is aluminum. Furthermore, this method also has advantages over a press fit insert as a press-fit insert is subjected to some level of deformation which can affect tolerances of the insert. It should also be noted that while opening 404 is depicted extending completely through substrate 402, alternatively a pocket that does not extend through the substrate can also be utilized using a similar procedure.

Figure 5A:
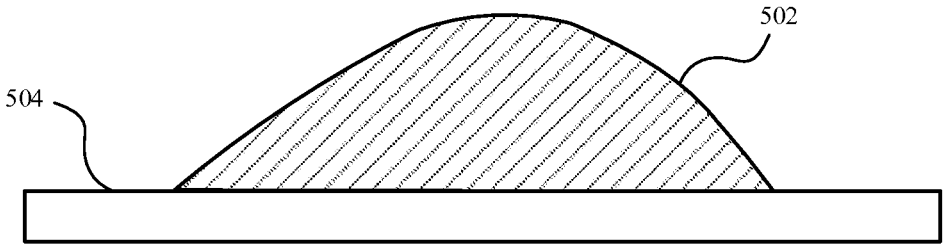
FIGS. 5A-5C illustrate steps for forming a part from solid state deposition materials formed on a substrate, in accordance with the described embodiments.
Figure 5B:
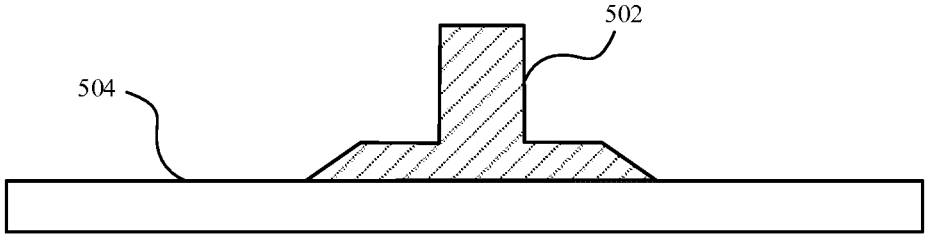
Figure 5C:
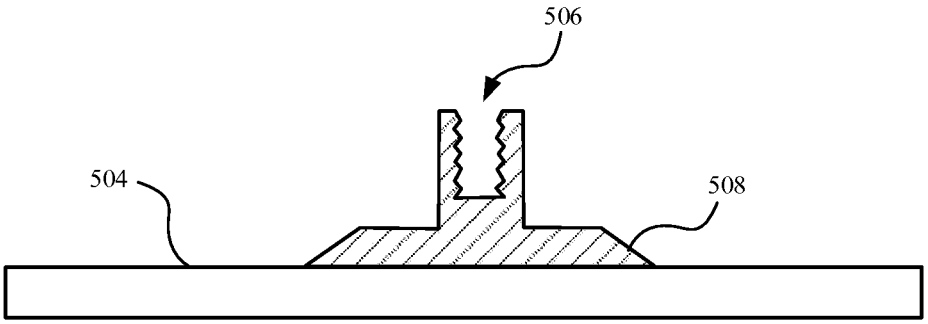

In some embodiments, a part can be formed by an additive manufacturing process making a feature entirely from cold spray material. In this regard, FIG. 5A illustrates a solid state deposition 502 formed on substrate 504. As illustrated in FIG. 5B, a portion of the solid state deposition 502 may be machined away to form an exterior geometry of the part. This may be a predetermined geometry based on a desired geometry. By forming the part in this manner, issues with respect to a heat affected zone causing cosmetic defects may be entirely avoided since no welding is required to join the part to substrate 504. FIG. 5C shows how threaded aperture 506 can be machined out to complete formation of boss 508. It should be noted that this technique is not limited to formation of bosses and can include formation of other protruding parts such as for example structural ribs or alignment features.

Figure 6A:
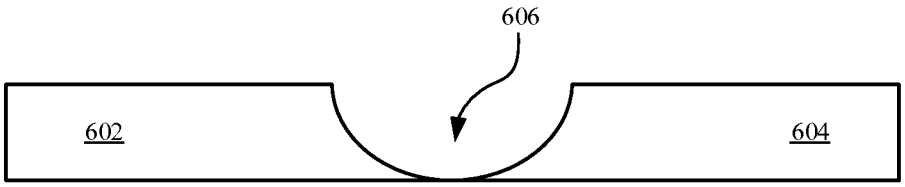
FIG. 6A-6C illustrate an embodiment in which a groove is filled with two different materials by sequential solid state deposition operations, in accordance with the described embodiments.
Figure 6B:
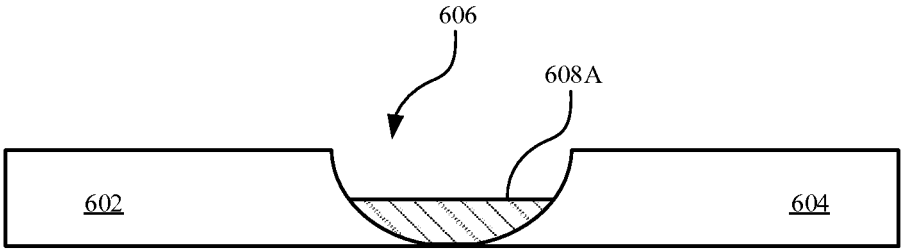
Figure 6C:
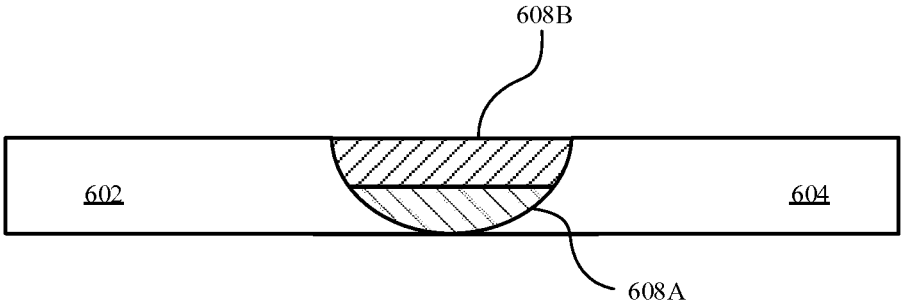

Note that although the solid state deposition is generally discussed herein as comprising a single type of material, in other embodiments multiple materials may be employed. For example, FIG. 6A illustrates first part 602 and second part 604 with a groove 606 therebetween. FIG. 6B shows how groove 606 is filled by first solid state deposition 608A that includes a first material. FIG. 6C shows how second solid state deposition 608B that includes a second material that differs from the first material can be deposited subsequent to deposition of first solid state deposition 608A. Thus, second solid state deposition 608B can define a material and configuration configured to match the surrounding material of the parts 602, 604 for cosmetic purposes. However, first solid state deposition 608A, which may be entirely hidden from view, may be selected to define other desirable characteristics. Thus, for example, first solid state deposition 608A may include titanium or other material configured to provide the assembly with high strength and light weight, whereas second solid state deposition 608B may comprise aluminum in order to match the surrounding first part 602 and second part 604. Note that titanium is generally not work-hardenable, and hence solid state deposition does not cause it to become brittle. However, various other materials may be employed in other embodiments.

Figure 7A:
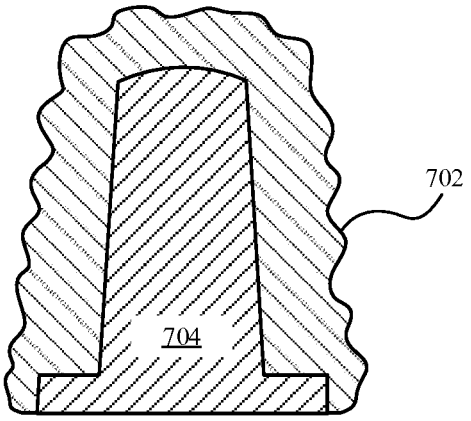
FIGS. 7A-7C illustrate how a cavity having a specific size and dimensions can be formed by melting a removable body subsequent to a cold spray operation, in accordance with the described embodiments.
Figure 7B:
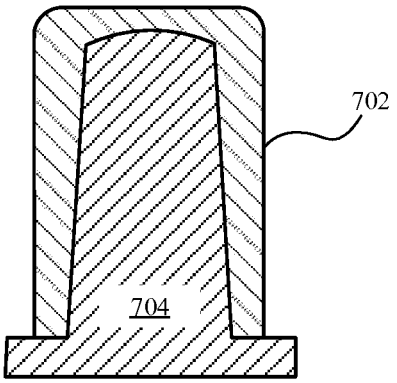
Figure 7C:
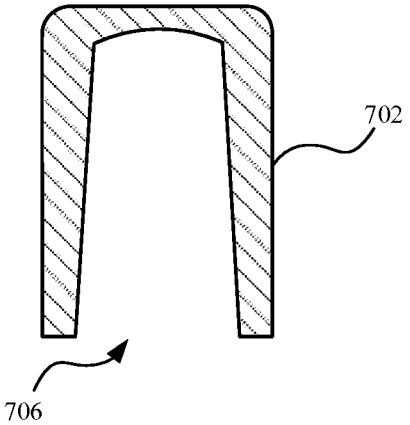

Solid state deposition may also be employed to form internal voids having specific geometries. In this regard, FIG. 7A illustrates a cross-sectional view of solid state deposition 702 deposited on removable body 704 (also referred to as a sacrificial body) positioned on substrate 706. After solid state deposition 702 is formed, a portion of the solid state deposition 702 can be removed by a machining operation. The machining operation can cause an exterior geometry of solid state deposition 702 to have a geometry along the lines of the geometry shown in FIG. 7B. During the machining operation, removable body 704 can provide support to solid state deposition 702, thereby preventing deformation of removable body 704. FIG. 7C shows removable body 704 removed. For example, removable body 704 can be removed by dissolving or melting means. In this regard, removable body 704 may be formed from materials such as foam, wood, honeycomb, etc. After removal of removable body 704, void 708 may be defined in the space previously filled by removable body 704 as depicted in FIG. 7C, providing the resulting assembly with a lightweight construction. In some embodiments, components can be subsequently added within void 708. Void 708 has the benefit of being defined by sidewalls without any substantial machining defects such as burrs or scratches. This can be highly beneficial when mounting a component within void 708 that is susceptible to damage from scratching or puncture.

Figure 8A:
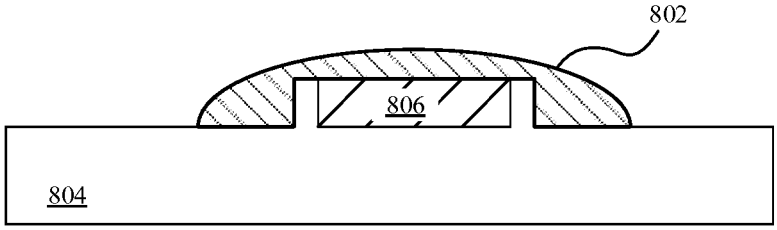
FIGS. 8A-8B illustrate how a hollow structure can be formed by solid state deposition, in accordance with the described embodiments.
Figure 8B:
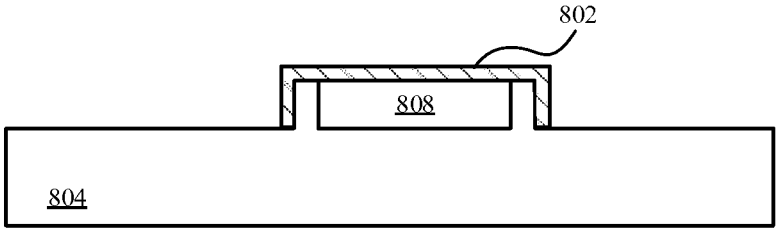

FIGS. 8A-8B show another hollow structure that can be formed by solid state deposition. In FIG. 8A cold spray 802 is deposited over substrate 804 and removable body 806. Subsequent to deposition of cold spray 802, removable body 806 can be removed by melting or in some cases dissolving to leave void 808, as depicted in FIG. 8B. An exterior portion of cold spray 802 can be machined away, which is also depicted in FIG. 8B. This configuration can provide a number of unique advantages. For example, cold spray 802 can be operable as a structural rib. When a structural rib is subject to a bending moment, stress is typically concentrated along a periphery of the rib. For this reason, void 808 may not provide a reduction in strength associated with the structural rib, and substantial weight savings can be realized. Void 808 can also be utilized to conduct audio signals. Because cold spray 802 can effectively seal itself to substrate 804, leakage of audio out of void 808 can be extremely minimal. In some configurations, void 808 can form a channel through which cooling air can flow.

Figure 9A:
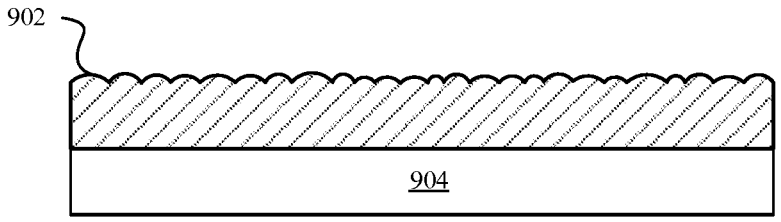
FIG. 9A-9D illustrate formation of an assembly with a component embedded within layers of solid state deposition, in accordance with the described embodiments.
Figure 9B:
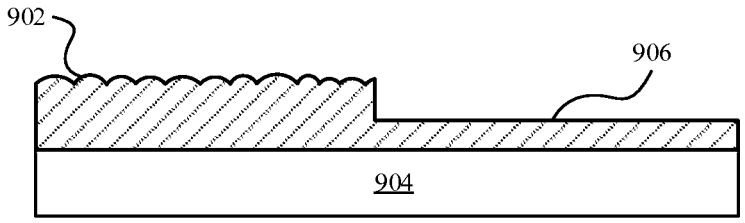
Figure 9C:
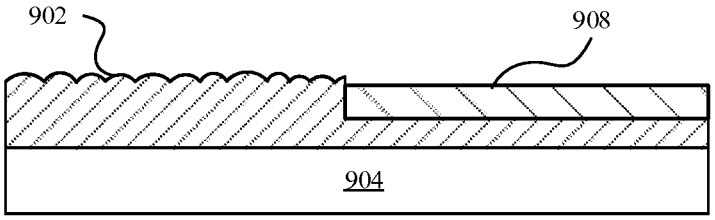
Figure 9D:
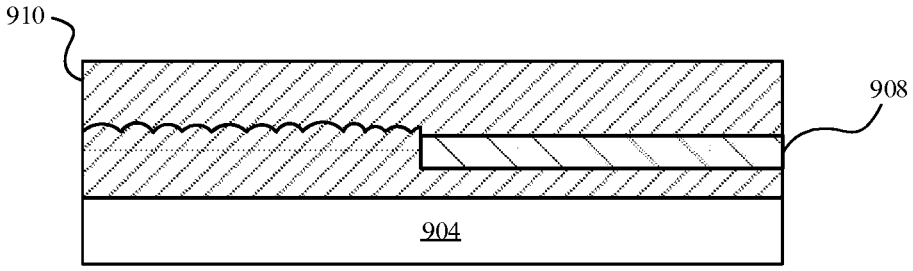

FIGS. 9A-9D illustrate formation of an assembly with an embedded item within a solid state deposition, in accordance with the described embodiments of the present disclosure. As illustrated in FIG. 9A, first solid state deposition 902 can be deposited on substrate 904. FIG. 9B illustrates how pocket 906 can be machined in first solid state deposition 902. FIG. 9C illustrates how item 908, such as a thermally or electrically conductive item (e.g., copper, graphite, carbon fiber, a heat pipe, etc.) may be placed in pocket 906. In some embodiments, operational components, such as antennas can be embedded in this way. Thereafter, second solid state deposition 910 can be employed to enclose item 908 in pocket 906. Second solid state deposition 910 can be formed from the same material as first solid state deposition 902, or in other embodiments, can be formed of a different material.

Figure 10A:
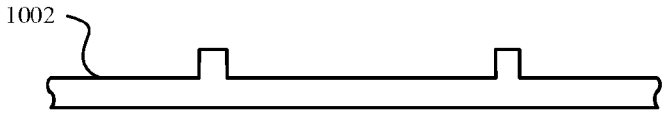
FIGS. 10A-10D illustrate steps for forming a multi-layer assembly, each of the layers having varied material properties, in accordance with the described embodiments.
Figure 10B:
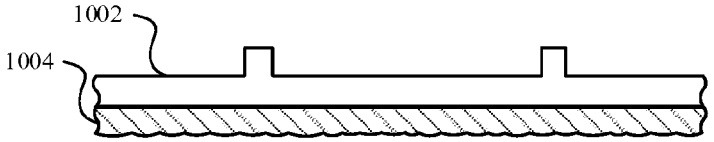
Figure 10C:
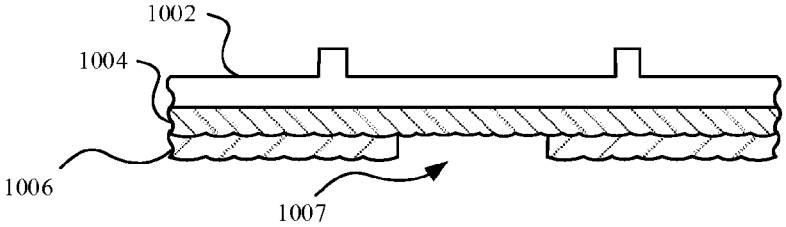
Figure 10D:
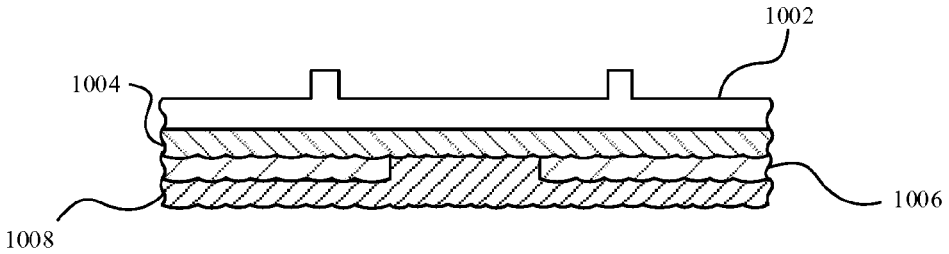

FIGS. 10A-10D illustrate formation of a multi-layer assembly. Each layer of the multi-layer assembly can impart different beneficial characteristics to the assembly. FIG. 10A shows substrate 1002. Substrate 1002 can be a small portion of a larger structure, such as a device housing. FIG. 10B shows first cold spray layer 1004 applied to a bottom surface of substrate 1002. In some embodiments, first cold spray layer 1004 can follow an entire exterior surface of a housing associated with substrate 1002. Such a configuration may be desirable when first cold spray layer 1004 is optimized for conduction of thermal energy. Subsequent to application of first cold spray layer 1004, second cold spray layer 1006 can be selectively applied to first cold spray layer 1004. Selective application of second cold spray layer 1006 can be appropriate when second cold spray layer 1006 includes high cost and/or heavy materials. For example, second cold spray layer 1006 can include titanium for providing stiffness to substrate 1002. Application of second cold spray layer 1006 can then be limited to portions of substrate 1002 that need additional reinforcement or additional stiffness. Also, in some cases, it may be desirable to remove a portion of second cold spray layer 1006. FIG. 10C shows the embodiment shown in FIG. 10B, with gap 1007 formed within second cold spray layer 1006. This allows for a subsequent layer to be formed on both first cold spray layer 1004 and second cold spray layer 1006. For example, FIG. 10D shows application of third cold spray layer 1008 formed on first cold spray layer 1004 and second cold spray layer 1006. Third cold spray layer 1008 can be configured to fill in gaps e.g., gap 1007 shown in FIG. 10C) where second cold spray layer 1006 was not applied. Furthermore, it can also cover second cold spray layer 1006 so that an exterior surface of the multi-layer assembly is substantially uniform in appearance. In some embodiments, second cold spray layer 1006 can have material properties that facilitate application of a highly polished cosmetic surface, and/or can be configured to receive an anodization layer.

Figure 11A:
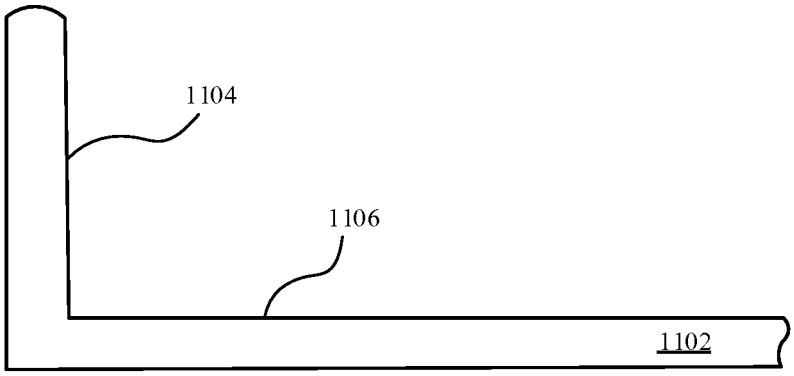
FIGS. 11A-11D illustrate a number of steps for securing a clutch element to a device housing, in accordance with the described embodiments.
Figure 11B:
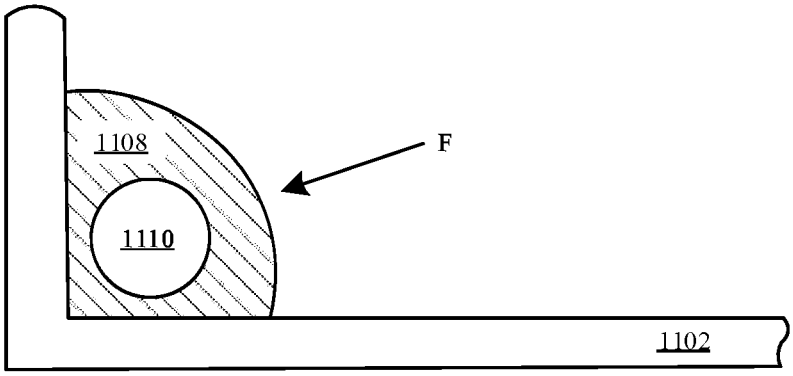
Figure 11C:
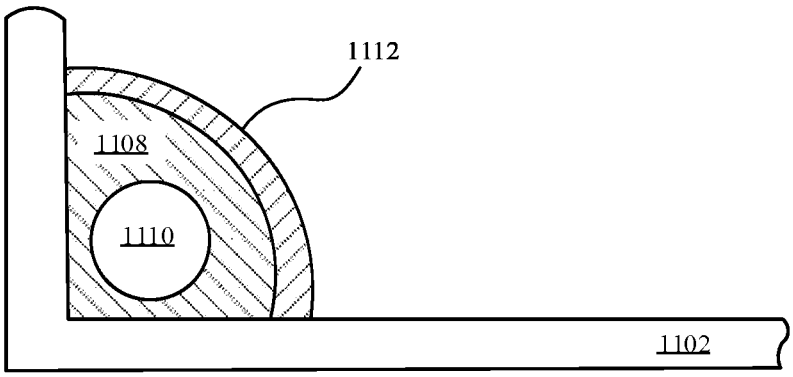
Figure 11D:
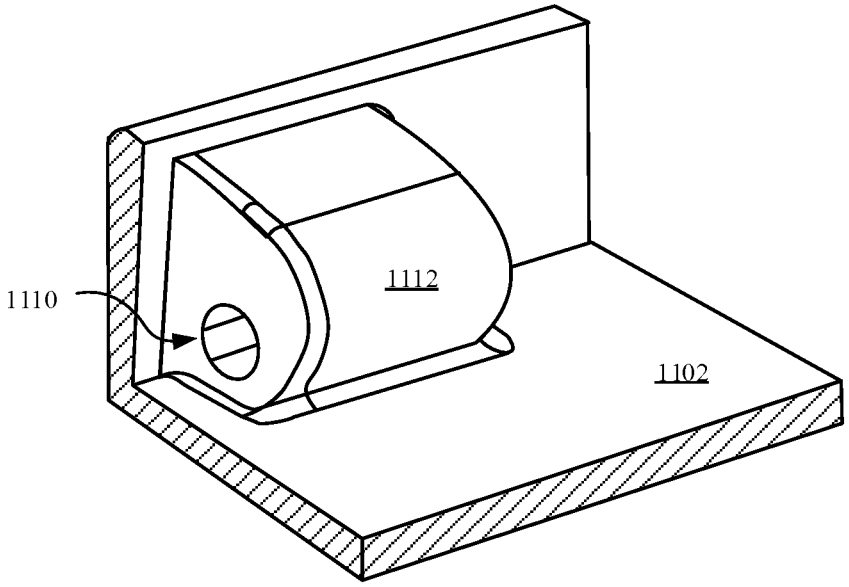

FIGS. 11A-11E illustrate a number of steps for securing a hinge or clutch element to a housing 1102 of an electronic device. FIG. 11A shows a side view of a portion of housing 1102 for a portable computing device. The housing includes sidewall 1104 and bottom wall 1106. FIG. 11B shows clutch component 1108 being pressed against sidewall 1104 of housing 1102 with a Force F to press clutch component 1108 against sidewall 1104 and bottom wall 1106. Clutch component 1108 can have a geometry complementary to a geometry of sidewall 1104 and an adjacent portion of bottom wall 1106. Clutch component 1108 can also have an opening 1110 for receiving a shaft portion of an associated clutch assembly component. FIG. 11C shows clutch component 1108 subsequent to receiving a layer of cold spray 1112. Once cold spray 1112 is applied, clutch component 1108 becomes effectively secured to housing 1102. In some embodiments, clutch component 1108 can be formed of steel and cold spray 1112 can also be formed of steel thereby creating a robust coupling between clutch component 1108 and housing 1102. A moment can be applied to clutch component 1108 that is typical of a moment transmitted from the shaft to clutch component 1108 during normal operation of the clutch component. As depicted, sidewall 1104, bottom wall 1106 and cold spray 1112 can all cooperate to prevent clutch component 1108 from becoming disengaged from housing 1102 as a result of the moment. FIG. 11D shows a perspective view of clutch component 1108 covered by cold spray 1112. It should be noted that opening 1110 can receive a portion of cold spray 1112 if not covered during a deposition operation. In cases where opening 1110 is not covered during deposition, cold spray 1112 can be machined out of opening 1110. In other embodiments, opening 1110 can be formed after deposition of cold spray 1112. In this way, clutch component 1108 can be securely adhered to housing 1102 without need for screws or adhesive.

Figure 12A:
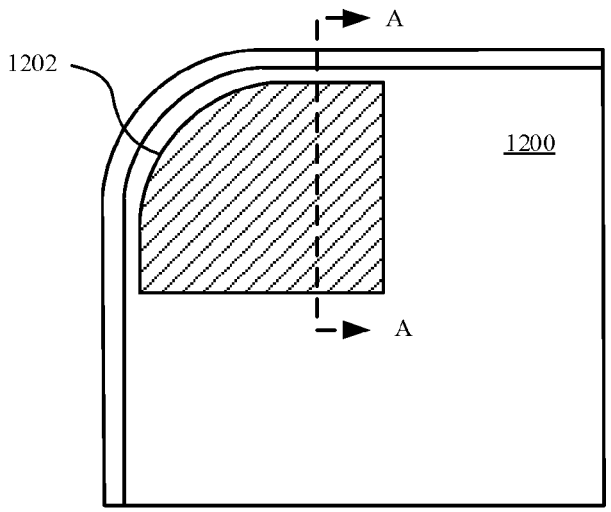
FIGS. 12A-12D illustrate various embodiments in which a stiffener or bracket can be cold sprayed directly to a device housing to provide structural support to the device housing.
Figure 12B:
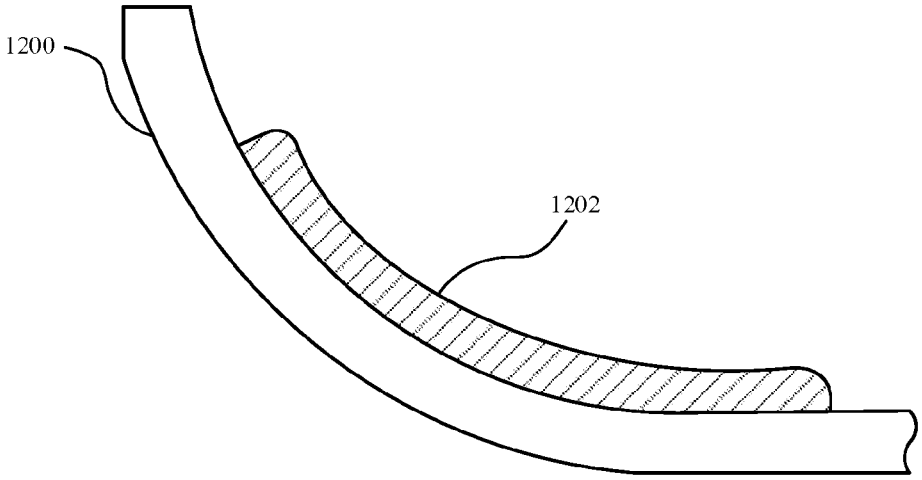
Figure 12C:
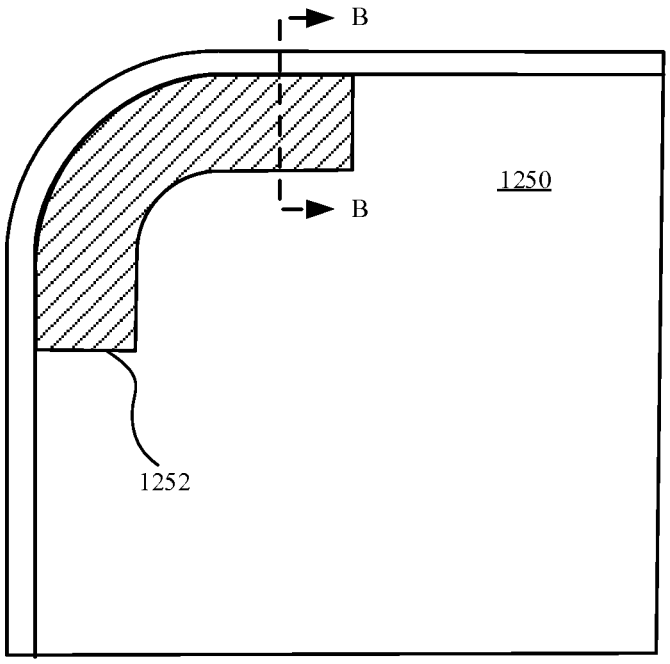
Figure 12D:
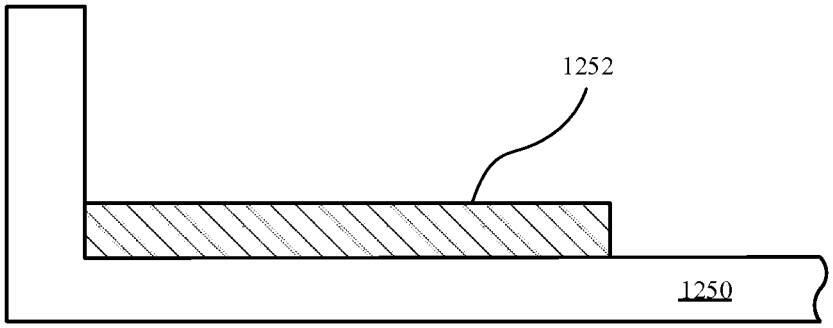

FIGS. 12A-12D show various embodiments in which a cold spray operation can be applied to form a reinforcement feature. FIG. 12A shows a partial top view of an interior of a housing 1200 of an electronic device. In some embodiments, housing 1200 is formed from aluminum. When exterior walls of housing 1200 are particularly thin, curved corner portions of housing 1200 can be particularly susceptible to damage. In some embodiments, a corner portion of housing 1200 can be reinforced by applying cold spray to form stiffener 1202. In one embodiment, stiffener 1202 is formed from steel particles. By cold spraying stiffener 1202 to housing 1200, use of adhesives can be avoided, reducing a volume (or stack) taken up by the adhesive, and allowing a robust connection between the stiffener 1202 and housing 1200 to be formed. FIG. 12B shows a partial cross-sectional side view in accordance with section line A-A in FIG. 12A. This cross-section makes it clear how stiffener 1202 can adhere to a thin, curved surface of housing 1200, thereby reinforcing the curved geometry to substantially reduce a likelihood of damage to the corner during a drop event. Furthermore, because an extra layer of adhesive is not required, more room is left within housing 1200 for additional components. FIG. 12C shows a partial top view of an interior of a housing 1250 of an electronic device. A corner bracket 1252 formed from a solid state deposition is formed along a corner of housing 1250. Corner bracket 1252 can help to prevent damage to the corner in the event of a drop event. FIG. 12D shows a partial cross-sectional side view of corner bracket 1252 in accordance with line B-B shown in FIG. 12C. FIG. 12D shows how corner bracket 1252 can be in direct contact with a sidewall of housing 1250. In this way, a corner portion of housing 1250 can be substantially reinforced. This can be especially effective when the material forming corner bracket 1252 is formed of a stronger or more rigid material than the material used to form housing 1250. For example, housing 1250 can be formed of aluminum while corner bracket 1252 can be formed of stainless steel.

Figure 13A:
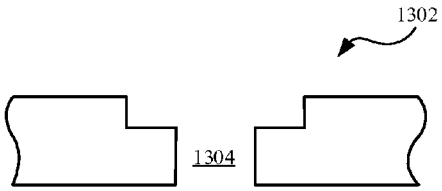
FIGS. 13A-13I illustrate various methods for forming a reinforcement band for an IO port, in accordance with the described embodiments.
Figure 13B:
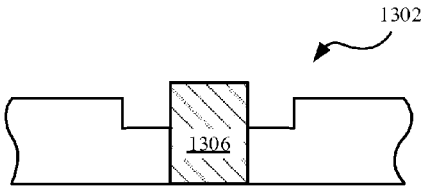
Figure 13C:
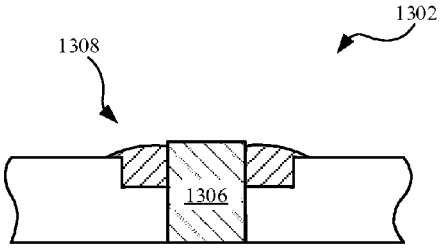
Figure 13D:
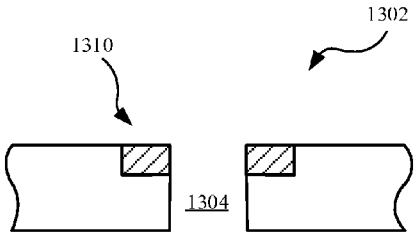
Figure 13E:
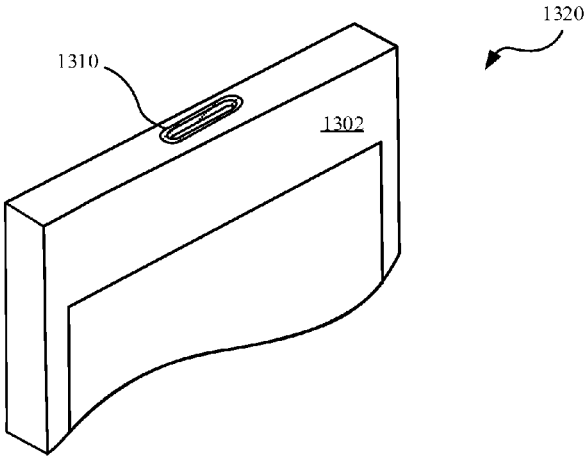

FIGS. 13A-13I show cross-sectional views of housing 1302 and various methods for applying a solid state deposition (e.g., cold spray) to form a reinforced opening for an I/O port. The I/O port may be configured to receive, for example, a jack for headphones or a connector of a power cord. FIG. 13A shows housing 1302 and opening 1304 machined from housing 1302. Opening 1304 includes a shoulder region for defining the reinforced I/O port opening. In FIG. 13B, plug 1306 is inserted within opening 1304. Plug 1306 cooperates with the shoulder regions of opening 1304 to define a channel for receiving cold spray material. FIG. 13C shows cold spray material deposited within the channel. Finally, in FIG. 13D, plug 1306 is removed and the cold spray material is machined to match a surrounding portion of housing 1302, thereby forming reinforced band 1310. In this way, reinforced band 1310 can protect a peripheral portion of the I/O port. FIG. 13E shows a partial perspective view of a portion of electronic device 1320 with reinforced band 1310. Reinforced band 1310 can be formed of polished steel which provides both a cosmetically appealing appearance and structural reinforcement for the I/O port.

Figure 13F:
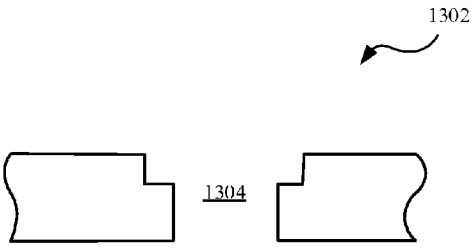
Figure 13G:
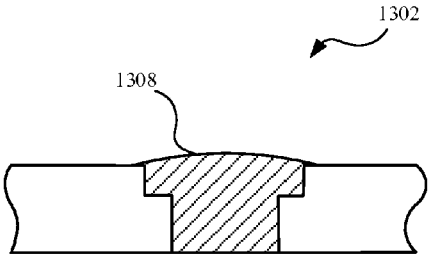
Figure 13H:
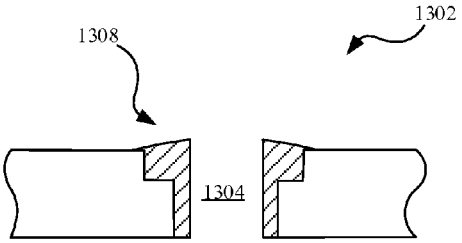
Figure 13I:
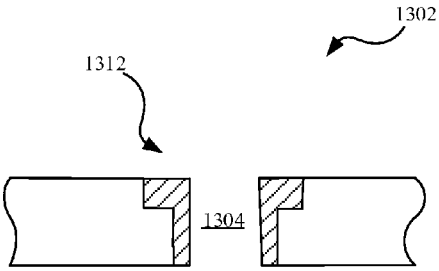

Alternatively, plug 1306 can be omitted from this described process. FIG. 13F shows opening 1304 machined into housing 1302. Opening 1304 is then filled with cold spray 1308 as depicted in FIG. 13G. Opening 1304 is then reformed (by a material removal process) and can pass entirely through housing 1302, as depicted in FIG. 13H, providing access to a connector circuit disposed within the housing 1302. Finally, in FIG. 13I, a top portion of cold spray 1308 is machined away leaving reinforced band 1312 of cold spray material disposed around opening 1304. In some embodiments, reinforced band 1312 is formed of polished stainless steel.

Figure 14A:
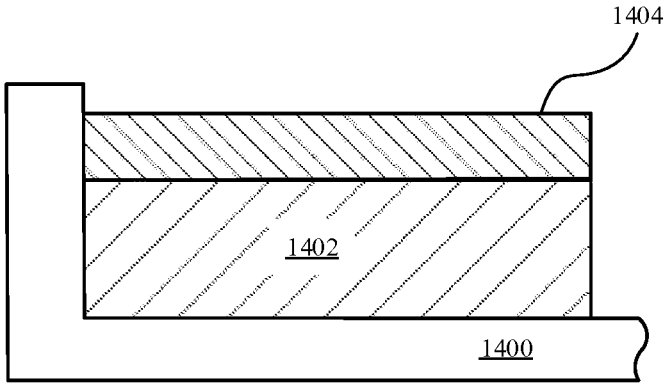
FIGS. 14A-14F illustrate various methods for forming a structure along a sidewall portion of a device housing.
Figure 14B:
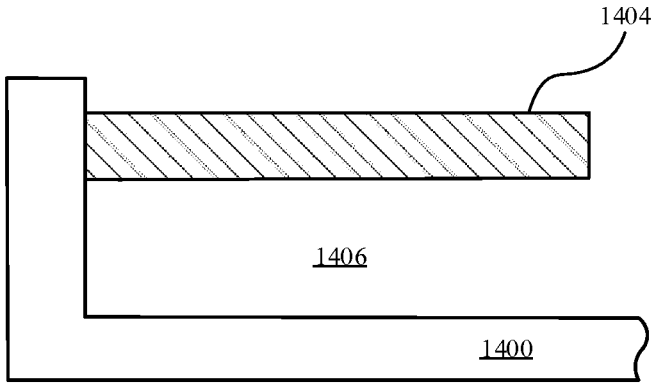
Figure 14C:
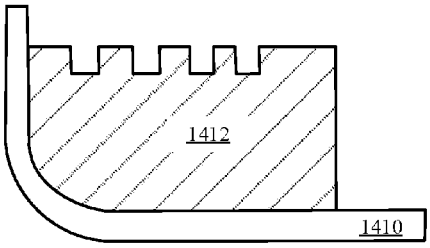
Figure 14D:
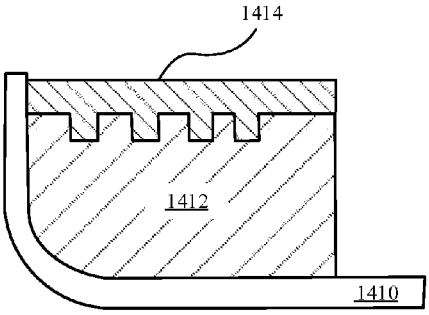
Figure 14E:
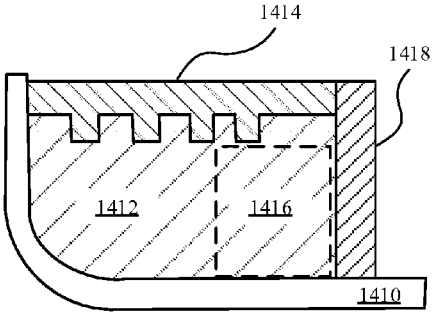
Figure 14F:
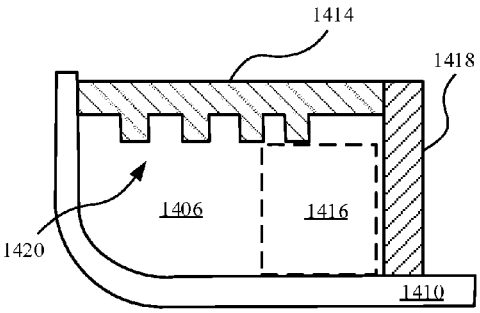

FIG. 14A shows a cross-sectional side view of a housing 1400, showing removable body 1402 disposed in a corner region of housing 1400 with cold spray applied to a top surface of the removable body 1402 to form wall 1404. FIG. 14B shows how removable body 1402 can be removed, leaving wall 1404 to create void 1406 having a substantial undercut geometry within which various components can be positioned. FIG. 14C shows housing 1410 with a removable body 1412 disposed within a corner region of the housing 1410. Removable body 1412 includes a number of complex features along its top surface for forming features with cold spray material. For instance, removable body 1412, as shown in FIG. 14C, includes a rib structure. FIG. 14D illustrates a structured formed on removable body 1412 by a solid state deposition process (e.g., cold spray). As shown, removable body 1412 includes a solid state deposition layer defined by wall 1414 formed against the complex features of removable body 1412. FIG. 14E shows how in some embodiments, removable body 1412 can include an embedded component 1416. While embedded component 1416 is shown completely embedded in removable body 1412, in some embodiments, embedded component 1416 protrudes freely from removable body 1412 so that at least a portion of embedded component 1416 can define a geometry of a part cold sprayed against it. Also depicted in FIG. 14E is wall 1418 which can be deposited against both removable body 1412 and wall 1414. Wall 1418 may be formed by similar means as that of wall 1414. In this way removable body 1412 can be completely enclosed by walls 1414 and 1418. Finally in FIG. 14F, removable body 1412 is removed, leaving behind embedded component 1416. When removable body 1412 is removed, resulting ribs 1420 remain disposed along an interior surface of wall 1414. Embedded component 1416 is unaffected by the removal of body 1412 and remains intact between walls 1414, 1418. When embedded component 1416 is an electrical component that emits electromagnetic interference (EMI), walls 1414 and 1418 which are seamlessly formed with each other cooperate to form an EMI can thereby preventing leakage of EMI radiated by embedded component 1416. In other words, walls 1414, 1418 combine to define a shield that prevents EMI from penetrating through walls 1414, 1418. Further, walls 1414, 1418 prevent EMI penetration thereby preventing EMI from reaching embedded component 1416.

Figure 14G:
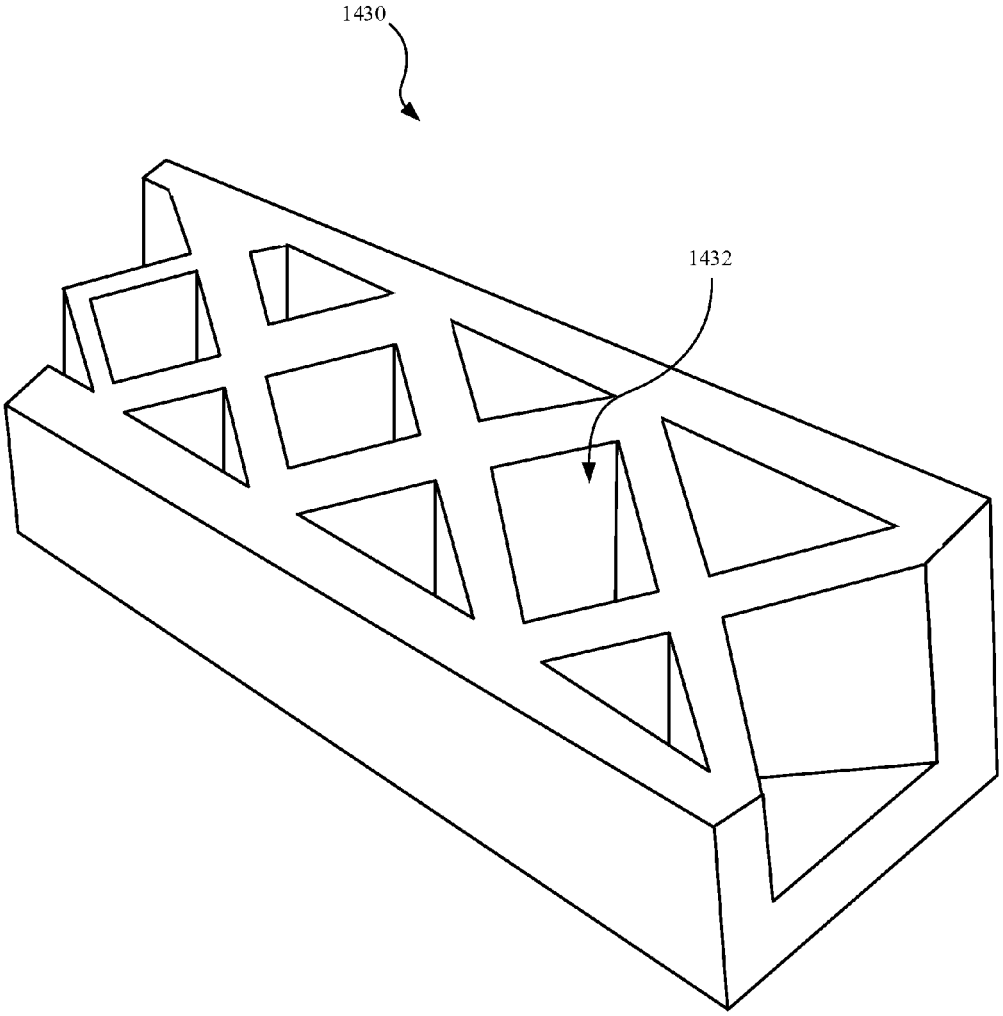
FIG. 14G illustrate a truss structure formed by a solid state deposition operation, in accordance with the described embodiments.

FIG. 14G shows how cold spray can be used to form a truss structure 1430. Voids 1432 in truss structure 1430 can be formed by a number of temporary inserts about which cold spray materials can be deposited. In this way, a high strength, low weight structural component can be formed without requiring complex machining operations.

Figure 15A:
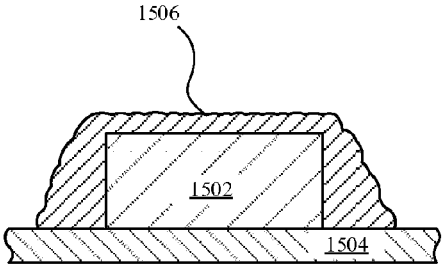
FIGS. 15A-15F illustrate steps for forming a hollow structure defining a front volume for an audio component, in accordance with the described embodiments.
Figure 15B:
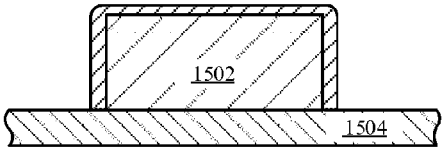
Figure 15C:
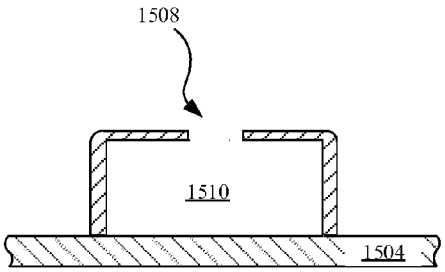
Figure 15D:
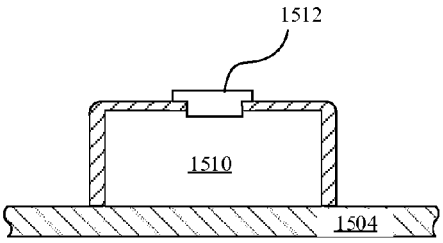
Figure 15E:
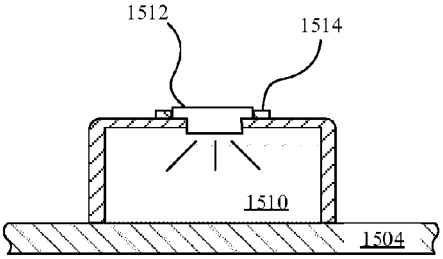
Figure 15F:
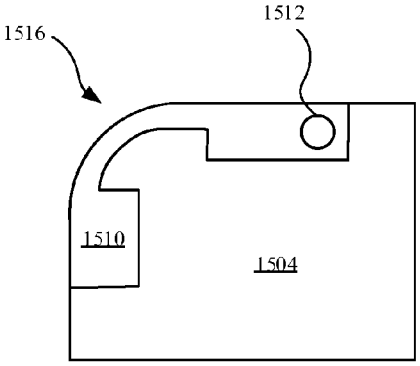

FIGS. 15A-15E show a number of steps for forming a hollow component configured to enhance audio performance of an electronic device. FIG. 15A shows removable body 1502 disposed on substrate 1504 and covered by cold spray 1506. Removable body 1502 may also be a sacrificial body, in accordance with the described embodiments. In FIG. 15B, an outside surface of cold spray 1506 is machined away. In FIG. 15C, removable body 1502 is removed leaving a void 1510 and an opening 1508 is machined through cold spray 1506. Also, the area enclosed by the housing and structure formed by cold spray 1506 define an acoustic volume. In FIG. 15D, audio component 1512, such as an audio driver, is inserted within opening 1508. Finally, in FIG. 15E, audio component 1512 is affixed and sealed within opening 1508 by a layer of adhesive 1514 disposed about the periphery of audio component 1512. In this way, void 1510 can form a front volume for audio component 1512. FIG. 15F shows a top view of audio component 1512 disposed within a corner portion of housing 1516 of an electronic device. Here, it can be seen that void 1510 can include an irregular geometry. In this way, a size of the front volume created by void 1510 can be maximized by taking up only space available within housing 1516.

Figure 16:
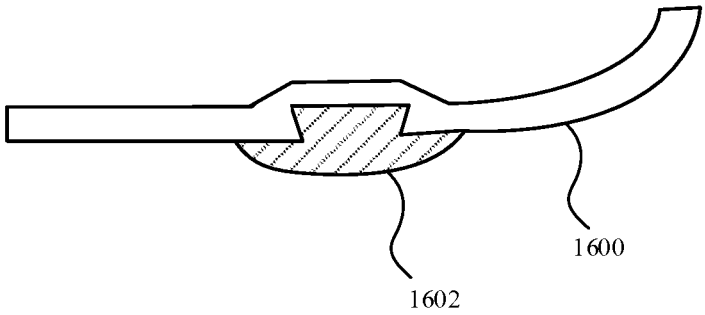
FIG. 16 illustrates a device foot formed by a solid state deposition operation, in accordance with the described embodiments.

FIG. 16 shows a cross-section of a housing 1600 and a device foot 1602 formed by a cold spray operation into an aperture of housing 1600. The aperture can have an undercut geometry or can have other geometries facilitating retainer of device foot 1602. Device foot 1602 can be subsequently shaped by a precision machining operation to have precise height with respect to an outside surface of housing 1600.

Figure 17:
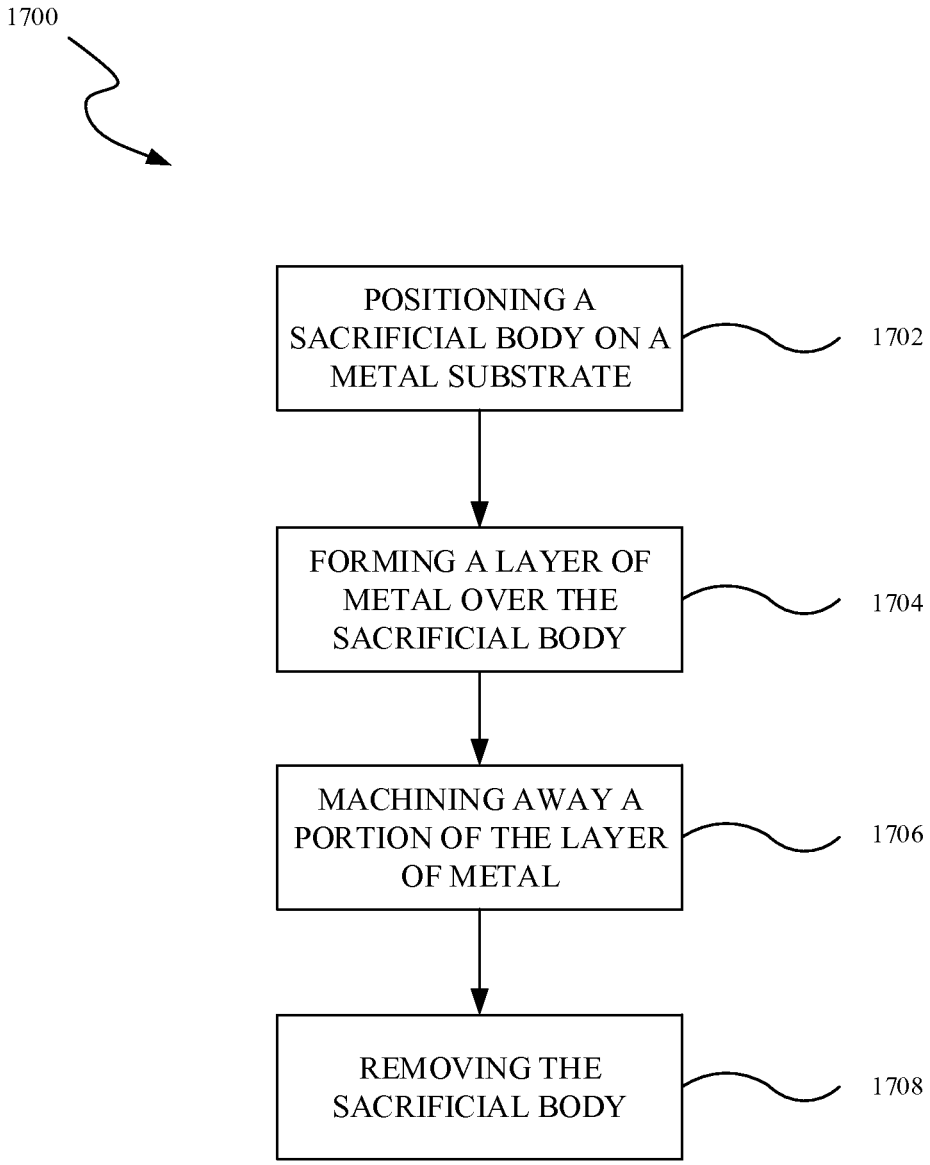
FIG. 17 illustrates a flowchart representing a method for forming a hollow structure, in accordance with the described embodiments.

FIG. 17 shows a flowchart 1700 representing a method for forming a hollow structure using a solid state deposition process. In step 1702, a sacrificial body is positioned on a metal substrate. In some embodiments, the sacrificial body can be adhered to the metal substrate to keep it in a precise position during the solid state deposition process. In step 1704, a layer of metal is deposited over the sacrificial body. The layer of metal can include a mixture of metal particles that have a desirable material property or properties. In some embodiments, the mixture is designed to blend with the metal substrate upon which it is deposited. In step 1706, a portion of an outside surface of the metal layer is machined away to achieve a predetermined geometry, or in some cases, to generate particular features along the outside surface. For example, a structural rib or attachment feature could be formed during such a machining process. In step 1708, the sacrificial body is melted or dissolved away, thereby allowing a cavity to be formed within the metal layer having a size and shape in accordance with the sacrificial body.

In the embodiments discussed above, solid state deposition is indicated as working with dissimilar materials on a substrate to which the solid state deposition is applied. In various other embodiments, the processes described above may be modified. For example, in some embodiments, particles defining differing particle sizes are deposited at the same time to provide the resulting solid state deposition with a more complex surface texture. Further, solid state deposition may be employed to create electrostatic discharge (ESD) shielding, electromagnetic pulse (EMP) shielding, and/or radio frequency (RF) leakage shielding, without damaging the shielded components. Additionally, the solid state deposition may be deposited to define complex structures such as in the form of trusses that provided a lightweight, yet strong, structure, rather than in uniform layers.

Figure 18:
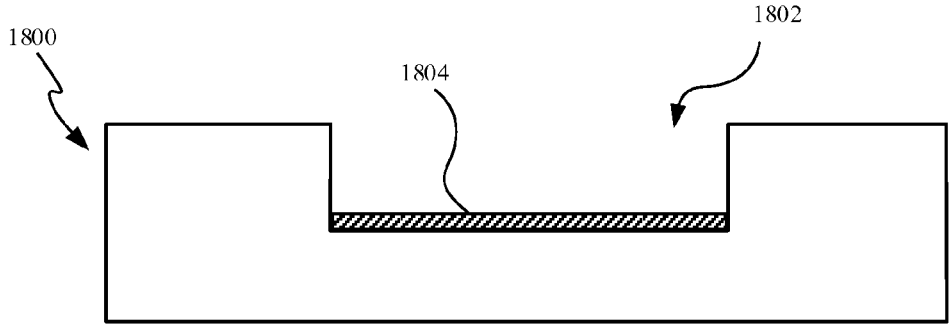
FIG. 18 illustrates a side view of a substrate having a channel formed within the substrate, in accordance with the described embodiments.
Figure 19:
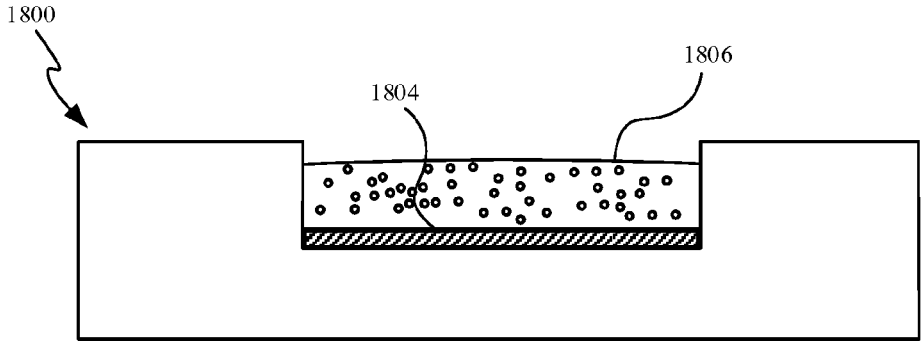
FIG. 19 illustrates the embodiment of the substrate shown in FIG. 18, with a second layer applied to the first layer.
Figure 20:
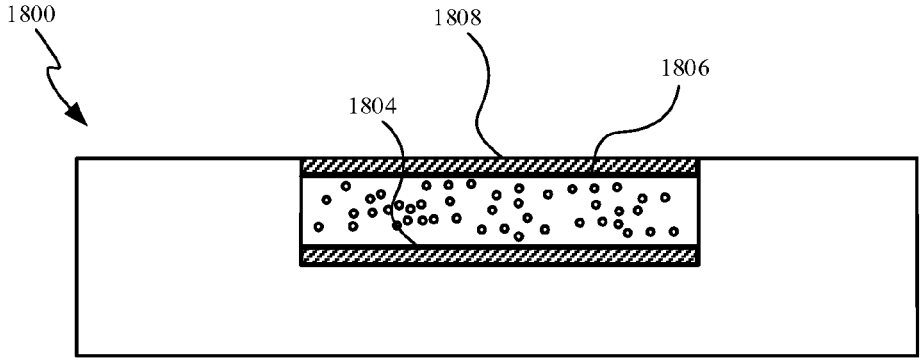
FIG. 20 illustrates the embodiment of the substrate shown in FIG. 18, with the third layer applied to the second layer.

In some cases, it may be necessary to strengthen a channel formed within a substrate. FIGS. 18-20 illustrate a process for using a solid state deposition process in a manner previously described to strengthen a channel. FIG. 18 illustrates a side view of substrate 1800 having channel 1802 formed within substrate 1800, in accordance with the described embodiments. Channel 1802 includes first layer 1804 formed by a solid state deposition process at a relatively high temperature and pressure. As a result, the density of first layer 1804 is relatively high as the particles are highly condensed, and in some cases, melted. First layer 1804 may be particles of metal such as aluminum, titanium, magnesium, or any other materials previously described for solid state deposition.

FIG. 19 illustrates the embodiment of substrate 1800 shown in FIG. 18, with second layer 1806 applied to first layer 1804. Second layer 1806 may also be formed from a solid state deposition process. However, the solid state deposition process used to form second layer 1806 uses a relatively low temperature and pressure, as compared to the temperature and pressure used to form first layer 1804. As a result, second layer 1806 is a relatively porous, i.e., less dense, layer as compared to first layer 1804.

FIG. 20 illustrates the embodiment of substrate 1800 shown in FIG. 19, with third layer 1808 applied to second layer 1806. Third layer 1808 may also be formed from a solid state deposition process. However, the solid state deposition process used to form third layer 1808 uses a relatively high temperature and pressure, as compared to the temperature and pressure used to form second layer 1806. For instance, third layer 1808 may be formed with a density substantially similar to that of first layer 1804. As a result, a solid state deposition process may include first layer 1804 and third layer 1808 forming relatively dense regions, with second layer 1806 positioned between first layer 1804 and third layer 1808. In order to ensure sufficient bonding, the layers described in FIG. 20 may be fused together. For example, second layer 1806 may fuse with both first layer 1804 and third layer 1808. This ensures the layers are intact.

Figure 21:
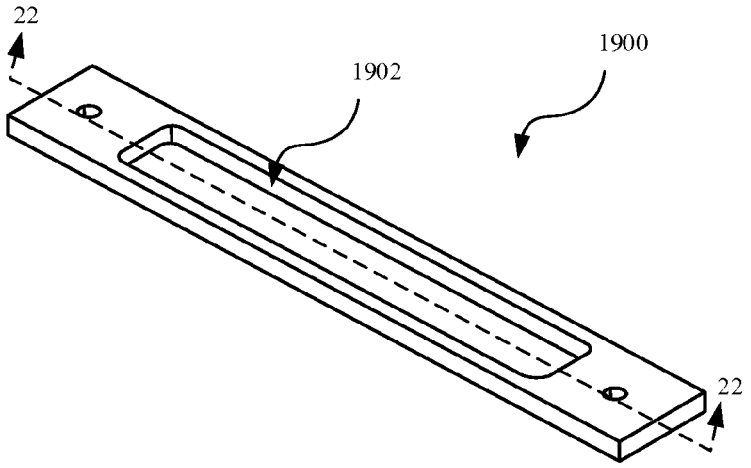
FIG. 21 illustrates an isometric view of a substrate having a channel formed within the substrate, in accordance with the described embodiments.

FIGS. 21-24 illustrate a technique for compensating for solid state deposition issues related to bonding together materials having different properties, such as different coefficients of thermal expansion. FIG. 21 illustrates an isometric view of substrate 1900 having channel 1902 formed within substrate 1900, in accordance with the described embodiments. In some embodiments, substrate 1900 is formed from aluminum. Also, in some embodiments, substrate 1900 is used as a stiffening member used in applications, for example, to provide support to a display housing of an electronic device.

Figure 22:
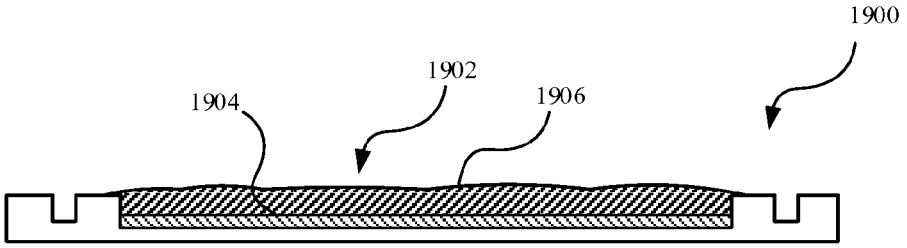
FIG. 22 illustrates a cross sectional view of the embodiment of the substrate shown in FIG. 21 taken along the 22-22 line, with the channel filled with a first layer and a second layer.

FIG. 22 illustrates a cross sectional view of the embodiment of substrate 1900 shown in FIG. 21 taken along the 22-22 line, with channel 1902 filled with first layer 1904 and second layer 1906. First layer 1904 can be formed form a solid state process previously described. First layer 1904 may include materials such as steel (e.g., stainless steel), stellite (chromium-cobalt), or a combination thereof. Generally, first layer 1904 is made from materials that erode when exposed to an anodization process that includes the use of one or more abrasive chemicals, such as phosphoric acid, sulfuric acid, and/or oxalic acid. As a result, first layer 1904 should be covered with another layer, such as second layer 1906. In some embodiments, second layer 1906 is formed from a solid state deposition process. Also, in some embodiments, second layer 1906 is formed from titanium particles. Generally, second layer 1906 may be formed from any material or materials capable of withstanding exposure to an anodization process. Also, second layer 1906 may be applied using relatively high heat (e.g., approximately 950 degrees Celsius) and relatively high pressures (e.g., 5 MPa).

Figure 23:
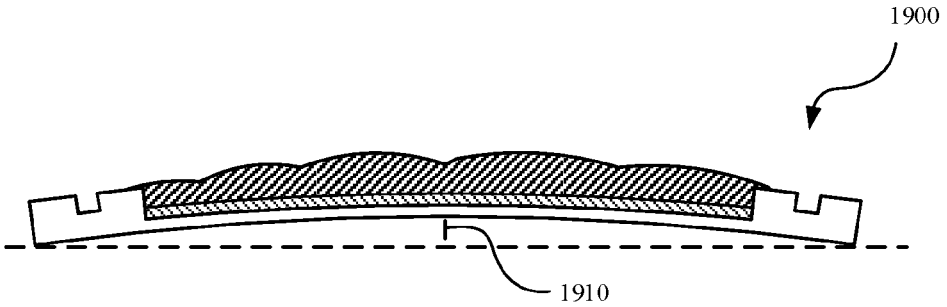
FIG. 23 illustrates the cross sectional view of the embodiment of the substrate shown in FIG. 22 shortly after the second layer is applied over the first layer.

While, second layer 1906 is suitable for withstanding harsh environments, the application process can create certain issues. For example, FIG. 23 illustrates the cross sectional view of the embodiment of substrate 1900 shown in FIG. 22 shortly after second layer 1906 is applied over first layer 1904. As shown, substrate 1900 is warped or bowed, particularly in a central region. This can be attributed in part to differences between substrate 1900 and second layer 1906. For example, substrate 1900 may include a temperature much lower than that of second layer 1906. For example, prior to applying second layer 1906, substrate 1900 may be at room temperature. However, at least some of the relatively high temperature of second layer 1906 is dissipated into substrate 1900 upon impact. Also, substrate 1900 may include a coefficient of thermal expansion much lower than that of second layer 1906. As a result, the increased temperatures cause substrate 1900 to change volume (or shape). In some cases, substrate 1900 may bow such that substrate 1900 includes a distance 1910 approximately in the range of 2 to 5 millimeters, where distance 1910 is measured from substrate 1900 to an imaginary horizontal plane. As a result, substrate 1900 may no longer be used in the intended applications.

Figure 24:
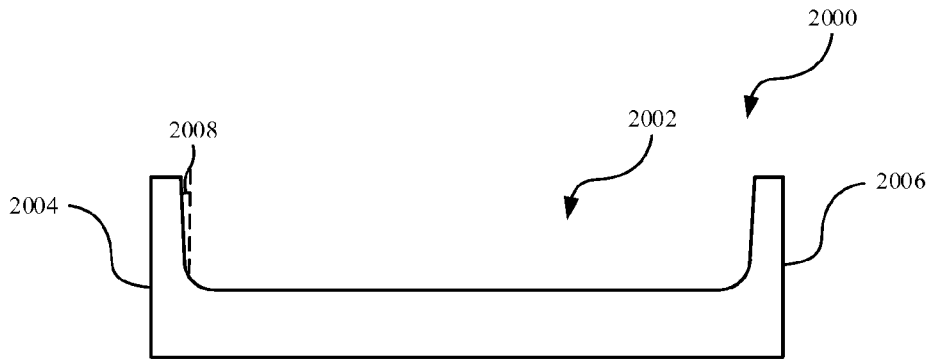
FIG. 24 illustrates a side view of an embodiment of a substrate having a channel having a first sidewall and a second sidewall formed at an angle.
Figure 25:
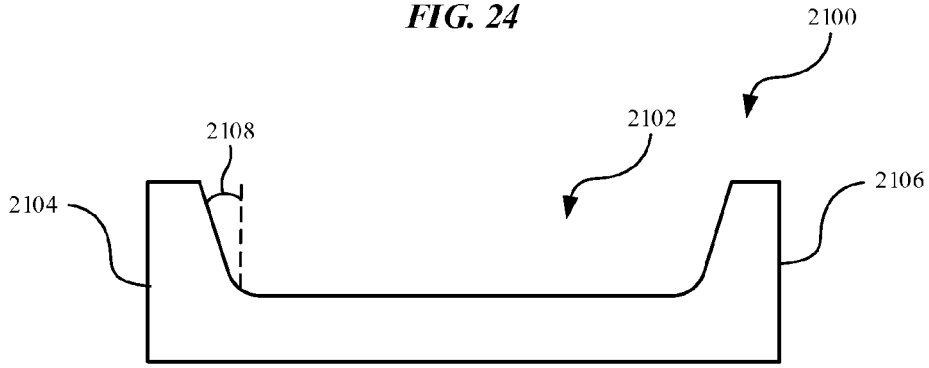
FIG. 25 illustrates a side view of an alternate embodiment of a substrate having a channel having a first sidewall and a second sidewall formed at an angle greater than the angle shown in FIG. 24.
Figure 26:
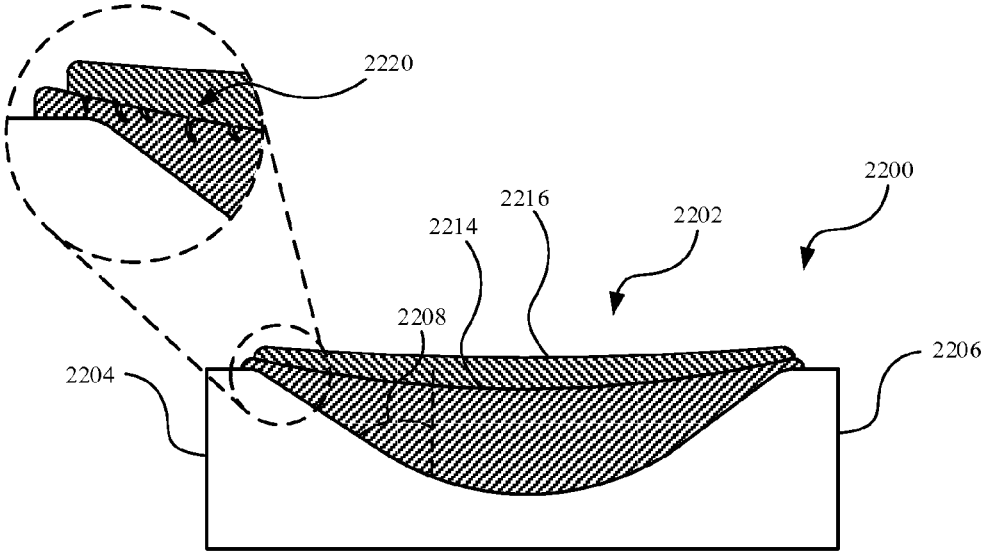
FIG. 26 illustrates a side view of an alternate embodiment of a substrate having s channel having s first sidewall and a second sidewall formed at an angle greater than the angle shown in FIG. 25.

The bonding of subsequent layers of solid state deposition may be improved based on the channel geometry of a substrate. For instance, a channel having relatively sharp edges, that is, edges formed from a vertical wall intersecting with a horizontal wall, may be less suited to receive solid state deposition. In this regard, FIGS. 24-26 illustrate substrates having channels with various geometries. FIG. 24 illustrates a side view of an embodiment of substrate 2000 having channel 2002 having first sidewall 2004 and second sidewall 2006 formed at angle 2008. As shown, first sidewall 2004 forms angle 2008 with respect to an imaginary vertical line. Angle 2008 may be approximately 10 degrees. Second sidewall 2006 may form an angle similar to that of angle 2008.

FIG. 25 illustrates a side view of an alternate embodiment of substrate 2100 having channel 2102 having first sidewall 2104 and second sidewall 2106 formed at angle 2108 greater than angle 2008 shown in FIG. 24. As shown, first sidewall 2104 forms angle 2108 with respect to an imaginary vertical line. Angle 2108 may be approximately 25 degrees. Second sidewall 2106 may form an angle similar to that of angle 2108.

FIG. 26 illustrates a side view of an alternate embodiment of substrate 2200 having channel 2202 having first sidewall 2204 and second sidewall 2206 formed at an angle 2208 greater than angle 2208 shown in FIG. 25. As shown, first sidewall 2104 forms angle 2208 with respect to an imaginary vertical line. Angle 2208 may be approximately in the range of 40 to 50 degrees. In particular, in some embodiments, angle 2208 is approximately 45 degrees. Second sidewall 2206 may form an angle similar to that of angle 2208.

Also, as shown in FIG. 26, substrate 2200 includes first layer 2214 and second layer 2216, both of which may be applied to substrate 2200 by separate solid state deposition processes. Traditional solid state deposition processes in which a channel having substantially horizontal and vertical surfaces may not allow second layer 2216 to bond with first layer 2214 in a desired manner. For example, small micro-cracks formed with first layer 2214 may not be fully filled with second layer 2216, particularly in substantially vertical cracks. However, as shown in the enlarged view of FIG. 26, first layer 2214 includes cracked region 2220 having several micro-cracks which are substantially, if not completely, filled with a portion of second layer 2216. In this manner, second layer 2216 is more tightly secured to first layer 2214. The increased angular configuration leads to less of a "transition region" defined by an edge region where two surfaces meat. The lesser transition region in turn allows for better particle deposition of a solid state deposition.

Figure 27:
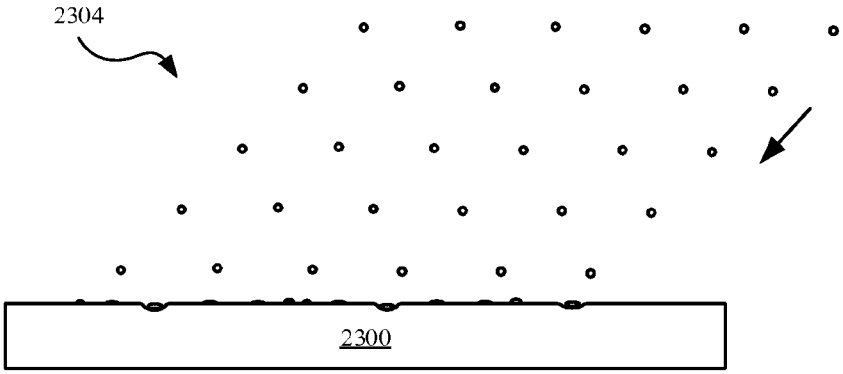
FIG. 27 illustrates an embodiment of a substrate undergoing a solid state deposition process to form a first layer on the substrate.
Figure 28:
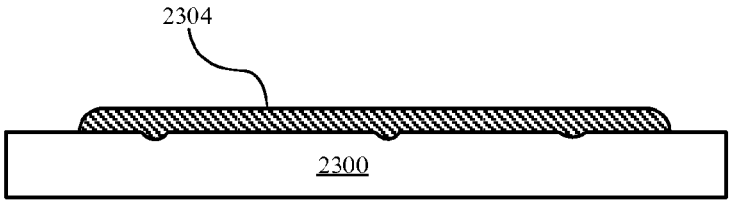
FIG. 28 illustrates the embodiment of the substrate shown in FIG. 27, with the solid state deposition process forming a first layer having a relatively flat or level surface on the substrate.
Figure 29:
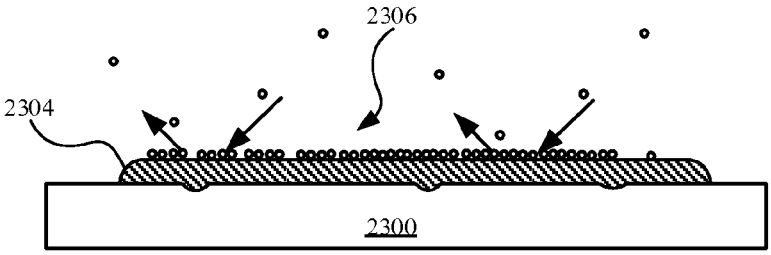
FIG. 29 illustrates the embodiment of the substrate shown in FIG. 28, with the substrate undergoing a second solid state deposition process to form a second layer over a portion of the first layer.

FIGS. 27-29 illustrate a first layer formed on a substrate, further with a second layer formed over the first layer. Both the first layer and the second layer may be applied to the substrate by a solid state deposition process. While the first layer may be applied to the substrate with relative ease, the materials forming the second layer may not bond with the first layer in a desired manner.

FIG. 27 illustrates an embodiment of substrate 2300 undergoing a solid state deposition process to form first layer 2304 on substrate 2300. In some embodiments, substrate 2300 is formed from aluminum. Also, in some embodiments, first layer 2304 is formed from a relatively dense material or materials as compared to substrate 2300, such as titanium particles. Also, first layer 2304 may include a relatively high melting point. As a result, first layer 2304 may deform or penetrate a portion of substrate 2300 upon impact, as shown in FIG. 27. FIG. 28 illustrates the embodiment of substrate 2300 shown in FIG. 27, with the solid state deposition process forming first layer 2304 having a relatively flat or level surface.

FIG. 29 illustrates the embodiment of substrate 2300 shown in FIG. 28, with substrate 2300 undergoing a second solid state deposition process to form second layer 2306 over a portion of first layer 2304. In some embodiments, second layer 2306 is formed from aluminum particles. In some cases, second layer 2306 includes a lower density than that of first layer 2304. Further, second layer 2306 may include a relatively lower melting point as compared to first layer 2304. As a result, second layer 2306 may not sufficiently bond with first layer 2304. For example, as shown in FIG. 29, some particles configured to form second layer 2306 carom off of first layer 2304. Alternatively, some particles configured to form second layer 2306 simply contact first layer 2304, as opposed to penetrating first layer 2304 in a manner similar to first layer 2304 penetrating substrate 2300 (as shown in FIG. 27). This is due in part to second layer 2306, having a relatively low melting point, being heated substantially during the solid state deposition process. This causes second layer 2306 to become at least partially melted, and accordingly, soft. Also, first layer 2304 may absorb heat from second layer 2306 upon impact, further reducing the bonding strength.

Figure 30:
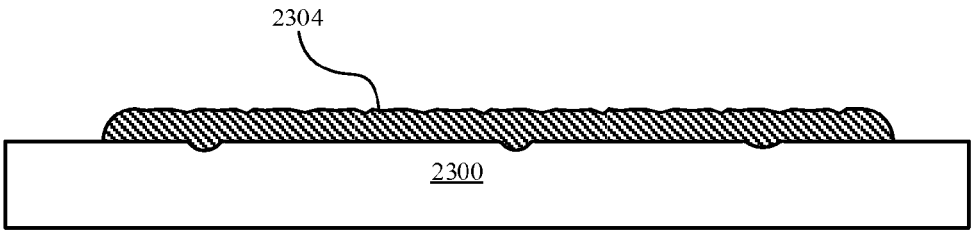
FIG. 30 illustrates the embodiment of the substrate shown in FIG. 28, with the first layer having a rough, unsmooth surface.
Figure 31:
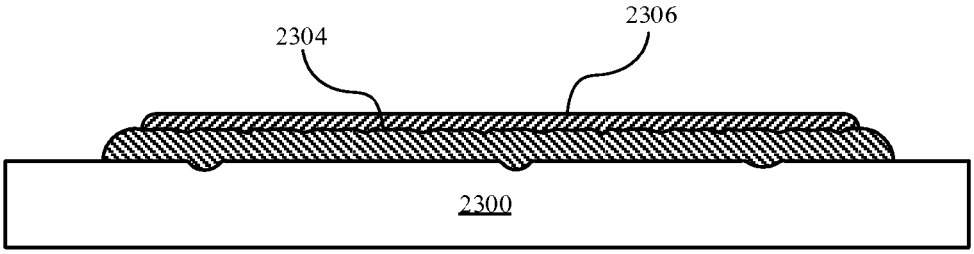
FIG. 31 illustrates the embodiment of the substrate shown in FIG. 30, with the second layer applied over the first layer.

However, some techniques may be used to form a stronger bond between first layer 2304 and second layer 2306. For example, FIG. 30 illustrates the embodiment of substrate 2300 shown in FIG. 28, with first layer 2304 having a rough or unsmooth surface. This may be accomplished by a material removal process such as blasting (e.g., sand blasting, grit blasting) first layer 2304. FIG. 31 illustrates the embodiment of substrate 2300 shown in FIG. 30, with second layer 2306 applied over first layer 2304. Second layer 2306 is able to bond with first layer 2304 due in part to the rough surface of first layer 2304. The rough surface allows second layer 2306 to better conform and mechanically lock with first layer 2304.

A method for forming a void within a structure may be performed by a solid state deposition process, in accordance with the described embodiments. The method includes spraying several discrete metallic particles on at least a portion of a sacrificial body that includes a size and a shape. The several discrete metallic particles can congeal or join subsequent to the spraying to form a corresponding metallic layer. The term "congeal" as used throughout this detailed description and in the claims refers to a solidification of particles when the particles have been deposited (e.g., by a cold spraying process). The method further includes creating the void within the layer having the size and shape of the sacrificial body by removing the sacrificial body in a manner that an external surface of the layer remains essentially undisturbed. The method further includes forming the structure by physically altering an external portion of the layer. In some embodiments, physically altering the external portion of the layer includes removing an amount of the layer subsequent to the spraying of the several discrete particles but prior to creating the void. Alternatively, in some embodiments, physically altering the external portion includes removing an amount of the layer subsequent to creating the void.

The sacrificial body may be removed by means such as dissolving and/or melting the sacrificial body. Also, the sacrificial body includes a melting temperature less than that of the layer of material. In this manner, the sacrificial body may be heated to a temperature above the melting temperature of the sacrificial body but lower than the melting temperature of the layer of materials. In this manner, the sacrificial body is melted but the layer of materials is not melted. Also, in some embodiments, a component is embedded within the sacrificial body. The component can remain in the void after the sacrificial body is removed.

In some instances, the sacrificial body includes an indentation having a size and a shape of a rib structure. In some cases, the rib structure is at least partially filled with the several discrete metallic particles during the spraying and wherein upon removal of the sacrificial body, at least some of the several discrete metallic particles congeal or join within the indentation form a corresponding rib structure. In some cases, rib structure provides a reinforcement to the layer of material after the sacrificial body is removed.

The sacrificial body can include an indentation having a size and a shape of a rib structure that is at least partially filled with metallic particles during the spraying and wherein upon removal of the sacrificial body, the congealed or joined metallic particles within the indentation form the rib structure A method of electrically isolating an electrical component may be performed by a solid state deposition process, in accordance with the described embodiments. The method includes spraying several discrete metallic particles that include a conductive material over at least a portion of a sacrificial body that carries the electrical component forming a conductive shield that acts as a barrier to passage of electromagnetic energy. The method further includes removing the sacrificial body in a manner that leaves the electrical component substantially unaffected and the conductive shield undisturbed. The conductive shield prevents most, if not substantially all, of the electromagnetic energy emitted by the electrical component from reaching an external environment. Moreover, the conductive shield prevents most, if not substantially all, of the electromagnetic energy from the external environment from reaching the electrical component.

In some cases, when the electrical component is capable of sending or receiving radio frequency (RF) energy, an opening is formed in the conductive shield that allows passage of the RF energy. Further, in some cases, only the opening allows passage of the RF energy. Also, in some cases, the opening is covered with a radio transparent material that prevents external contaminants from reaching the RF energy capable electrical component.

An electronic device may include a portion formed by a solid state process, in accordance with the described embodiments. The electronic device includes a housing. The electronic device further includes a component assembly carried by the housing. The component assembly includes an enclosure formed of a solid state deposition layer that includes several congealed (or joined) metallic particles that form a corresponding metallic layer that encloses and defines an internal volume. The component assembly may further include a component at least partially disposed within the internal volume. In some cases, the electronic device is capable of producing an audible sound.

In some embodiments, the component assembly further includes an audio transducer that provides acoustic energy. The audio transducer can be acoustically coupled to the internal volume to cooperate with the internal volume in a manner that converts the acoustic energy into the audible sound. Further, the enclosure may include an opening having a size and a shape that accommodates the audio transducer. In some cases, the audio transducer is positioned within the opening such that the audio transducer emits the acoustic energy into the internal volume.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for forming a metallic structure on a substrate having protruding members, the method comprising:

forming a metallic layer by using a solid-state deposition process to spray metallic particles over the protruding members and over a sacrificial body having a volume that is positioned between the protruding members;

forming the metallic structure by shaping an outer surface of the metallic layer using a machining process; and forming a void defined by the metallic structure, the protruding members, and the substrate by reducing the volume of the sacrificial body.

2. The method as recited in claim 1, wherein the volume of the sacrificial body is generally unchanged during the shaping of the outer surface of the metallic layer.

3. The method of claim 1, wherein top and side surfaces of the protruding members are covered by the metallic structure.

4. The method of claim 1, wherein the volume of the sacrificial body is reduced by using at least one of dissolving the sacrificial body or melting the sacrificial body.

5. The method of claim 3, wherein the top and side surfaces of the protruding members are unaltered during the shaping of the outer surface.

6. The method of claim 1, wherein a void volume corresponds to at least an amount of reduction of the volume of the sacrificial body.

7. The method of claim 1, wherein the sacrificial body has a higher melting point than a temperature at which the metallic particles are sprayed.

8. The method of claim 1, wherein, during spraying the metallic particles, the sacrificial body includes an indentation characterized as having a rib structure that is at least partially filled with the metallic particles such that upon altering the sacrificial body, the metallic particles within the indentation form a corresponding rib structure.

9. The method of claim 1, wherein at least a portion of the sacrificial body includes material having a lower melting point than a melting point of the metallic layer.

10. A method of electrically isolating an electrical component within a metallic structure, the method comprising:

forming the metallic structure by using a solid-state deposition process to deposit metallic particles over protruding members that are included on a substrate and over a sacrificial body positioned between the protruding members, wherein an electrical component is secured to the substrate and embedded within the sacrificial body, and the metallic particles act as a conductive shield that inhibits electromagnetic energy from passing through the metallic structure to interfere with the electrical component;

shaping an outer surface of the metallic structure by using a machining process; and forming a void defined by the metallic structure, the protruding members, and the substrate by altering the sacrificial body such as to reduce a volume of the sacrificial body, wherein the electrical component remains secured to the substrate and within the void subsequent to forming the void.

11. The method of claim 10, wherein the metallic structure is a structural rib.

12. The method of claim 10, wherein altering of the sacrificial body comprises heating the sacrificial body to a first melting temperature that is less than a second melting temperature associated with the metallic structure.

13. The method of claim 10, wherein the metallic structure includes at least one opening configured to allow passage of RF energy through the metallic structure.

14. The method of claim 10, wherein the metallic structure covers top and side surfaces of the protruding members.

* * * * *